US009239044B2

(12) United States Patent
Conley et al.

(10) Patent No.: US 9,239,044 B2
(45) Date of Patent: Jan. 19, 2016

(54) LANCE PUMP HAVING HORIZONTALLY MOUNTED STEPPER/SERVO MOTOR

(75) Inventors: Paul G. Conley, St. Charles, MO (US); Brad Allen Edler, Waterloo, IL (US)

(73) Assignee: Lincoln Industrial Corporation, St. Louis, MO (US)

( * ) Notice: Subject to any disclaimer, the term of this patent is extended or adjusted under 35 U.S.C. 154(b) by 643 days.

(21) Appl. No.: 13/423,986

(22) Filed: Mar. 19, 2012

(65) Prior Publication Data

US 2013/0243610 A1 Sep. 19, 2013

(51) Int. Cl.

| | |
|---|---|
| ***F04B 15/02*** | (2006.01) |
| ***F04B 49/06*** | (2006.01) |
| ***F04B 35/04*** | (2006.01) |
| ***F04B 23/02*** | (2006.01) |

(52) U.S. Cl.

CPC ..... *F04B 15/02* (2013.01); *F04B 23/025* (2013.01); *F04B 35/04* (2013.01); *F04B 49/065* (2013.01)

(58) Field of Classification Search

CPC .... F04B 4/08; F04B 4/065; F04B 2203/0209; F04B 15/02

USPC ..... 417/44.2, 63, 51.1, 551.2

See application file for complete search history.

(56) References Cited

U.S. PATENT DOCUMENTS

| | | | |
|---|---|---|---|
| 2,187,684 | A | 1/1940 | Fox et al. |
| 2,569,110 | A | 9/1951 | McGillis et al. |
| 2,627,320 | A | 2/1953 | Rotter |
| 2,636,441 | A | 4/1953 | Woelfer |
| 2,787,225 | A | 4/1957 | Rotter |
| 3,113,282 | A | 12/1963 | Coleman |
| 3,409,165 | A | 11/1968 | Creith |
| 3,437,771 | A | 4/1969 | Nusbaum |
| 3,469,532 | A | 9/1969 | Wegmann et al. |

(Continued)

FOREIGN PATENT DOCUMENTS

| | | | |
|---|---|---|---|
| DE | 9412699 | U1 | 12/1995 |
| DE | 19623537 | A1 | 12/1997 |

(Continued)

OTHER PUBLICATIONS

DE-19623537_with_Engish_Machine_Translation (Dec. 18, 1987).*

(Continued)

*Primary Examiner* — Charles Freay
*Assistant Examiner* — Kenneth J Hansen
(74) *Attorney, Agent, or Firm* — Senniger Powers LLP

(57) ABSTRACT

A pump for pumping viscous liquid. The pump includes a body, an elongate core, and a tube surrounding the core. A stepper or servo motor mounted on the body has a selectively rotatable output shaft. A transmission operatively connecting the motor output shaft and the elongate tube reciprocates the tube between a raised position and a lowered position. An inlet check valve defining an expansible lower chamber is oriented to open during each downward pumping stroke so liquid enters the lower chamber. The pump includes a pump chamber and a feed passage connecting the lower chamber to the pump chamber. The passage has a check valve oriented to open during each upward stroke to deliver liquid from the lower chamber to the pump chamber. An outlet passage connected to the pump chamber permits liquid to flow from the pump chamber to an outlet on each upward and downward stroke.

11 Claims, 16 Drawing Sheets

(56) References Cited

U.S. PATENT DOCUMENTS

| | | | | |
|---|---|---|---|---|
| 3,502,029 | A | 3/1970 | Halladay | |
| 3,510,234 | A | 5/1970 | Wolf | |
| 3,945,772 | A | 3/1976 | Van de Moortele | |
| 4,069,835 | A | 1/1978 | Stadler | |
| 4,243,151 | A | 1/1981 | Bruening | |
| 4,249,868 | A | 2/1981 | Kotyk | |
| 4,487,340 | A | 12/1984 | Shaffer | |
| 4,575,313 | A | 3/1986 | Rao et al. | |
| 4,718,824 | A | 1/1988 | Cholet et al. | |
| 4,735,048 | A | 4/1988 | Gregory | |
| 4,762,474 | A | 8/1988 | Dartnall | |
| 5,022,556 | A | 6/1991 | Dency et al. | |
| 5,025,827 | A | 6/1991 | Weng | |
| 5,178,405 | A | 1/1993 | Brandstadter | |
| 5,188,519 | A | 2/1993 | Spulgis | |
| 5,685,331 | A | 11/1997 | Westermeyer | |
| 5,725,358 | A * | 3/1998 | Bert et al. | 417/44.2 |
| 5,850,849 | A | 12/1998 | Wood | |
| 6,102,676 | A | 8/2000 | DiCarlo et al. | |
| 6,161,723 | A | 12/2000 | Cline et al. | |
| 6,244,387 | B1 | 6/2001 | Paluncic et al. | |
| 6,793,042 | B2 | 9/2004 | Brouillet | |
| 6,863,502 | B2 | 3/2005 | Bishop et al. | |
| 6,886,589 | B2 | 5/2005 | Oretti | |
| 2002/0157901 | A1 | 10/2002 | Kast et al. | |
| 2003/0206805 | A1 * | 11/2003 | Bishop et al. | 417/44.2 |
| 2005/0180870 | A1 | 8/2005 | Stanley et al. | |
| 2007/0253848 | A1 | 11/2007 | Lea, Jr. | |
| 2007/0289994 | A1 | 12/2007 | Kotyk | |
| 2008/0240944 | A1 | 10/2008 | Arens | |

FOREIGN PATENT DOCUMENTS

| | | | |
|---|---|---|---|
| GB | 2205905 | A | 12/1988 |
| WO | 96/41136 | A1 | 12/1996 |

OTHER PUBLICATIONS

International Search Report regarding corresponding PCT/US2013/030464, dated Sep. 27, 2013, 4 pages.

Written Opinion of the International Searching Authority, PCT/2013/030464, dated Sep. 27, 2013, 7 pages.

PCT International Search Report for PCT/US2013/030331 dated May 16, 2013, 4 pages.

Written Opinion of the International Searching Authority for PCT/US2013/030331 dated May 16, 2013, 10 pages.

* cited by examiner

LANCE PUMP HAVING HORIZONTALLY MOUNTED STEPPER/SERVO MOTOR

FIELD OF THE INVENTION

This invention relates to pumps, and more particularly to an expansible chamber pump of a type which may be referred to as a lance pump or drum pump, particularly adapted for pumping lubricant, including grease, from a supply thereof (e.g., lubricant in a drum).

BACKGROUND OF THE INVENTION

The pump of this invention is in the same field as the pumps shown in the following U.S. Pat. Nos. 2,187,684; 2,636,441; 2,787,225; 3,469,532; 3,502,029; 3,945,772; 4,487,340; 4,762,474; and 6,102,676, the latter of which is directed to a lance pump sold by Lincoln Industrial Corporation of St. Louis, Mo., under the trademark Flow Master®. U.S. patent application Ser. No. 13/331,249 describes another pump in the same general field as the pump of this invention. Although lance pumps such as those identified above have been commercially successful, there is a need for a pump that provides a selectively variable output pressure and reduces a need for complicated reduction gearing.

SUMMARY OF THE INVENTION

In one aspect, the present invention includes a pump for pumping a viscous liquid from a reservoir. The pump comprises a pump body adapted for positioning above the reservoir. The pump also includes an elongate core extending downward from an upper end fixedly connected to the body, past an upper portion and a lower portion, to a lower end when the body is positioned above the reservoir. An elongate tube surrounding the core extends vertically downward from the body into the liquid when the body is in position above the reservoir. The tube has a longitudinal axis extending between an upper end mounted on the body for vertical reciprocating motion and a lower end opposite the upper end extending past the lower end of the core. The tube has an upper closure and a lower closure slidably receiving the core and providing lateral support as the tube reciprocates. A stepper motor mounted on the body has a selectively rotatable output shaft extending horizontally above the liquid in the reservoir when the body is in position. The pump also comprises a transmission operatively connecting the stepper motor output shaft and the elongate tube for reciprocating the tube between the raised position and the lowered position as the stepper motor output shaft rotates to drive the tube through alternating upward and downward pumping strokes. An inlet check valve mounted inside the tube below the lower end of the core defines with the lower end of the core an expansible and contractible lower end chamber. The inlet check valve is oriented to open during each downward pumping stroke of the tube permitting viscous liquid to enter the lower end chamber. The pump has an annular pump chamber defined in part by the tube and the core above the lower end chamber. A feed passage in the tube connecting the lower end chamber to the annular pump chamber has a feed passage check valve oriented to open during each upward pumping stroke of the tube with the inlet check valve closed to deliver viscous liquid from the lower end chamber to the annular pump chamber. An outlet passage connected to the annular pump chamber permits viscous liquid to flow from the annular pump chamber to an outlet on each upward pumping stroke and each downward pumping stroke.

In another aspect, the present invention includes a pump for pumping a viscous liquid from a reservoir. The pump comprises a pump body adapted for positioning above the reservoir and an elongate core extending downward from an upper end fixedly connected to the body, past an upper portion and a lower portion, to a lower end when the body is positioned above the reservoir. Further, the pump has an elongate tube surrounding the core and extending vertically downward from the body into the liquid when the body is in position above the reservoir. The tube has a longitudinal axis extending between an upper end mounted on the body for vertical reciprocating motion and a lower end opposite the upper end extending past the lower end of the core. The tube has an upper closure and a lower closure slidably receiving the core and providing lateral support as the tube reciprocates. The pumps also includes a stepper motor mounted on the body having a selectively rotatable output shaft operatively connected to the elongate tube for reciprocating the tube between the raised position and the lowered position as the stepper motor output shaft rotates to drive the tube through alternating upward and downward pumping strokes. A control operatively connected to the stepper motor controls operation of the stepper motor. In addition, the pump comprises an inlet check valve mounted inside the tube below the lower end of the core and defining with the lower end of the core an expansible and contractible lower end chamber. The inlet check valve is oriented to open during each downward pumping stroke of the tube permitting viscous liquid to enter the lower end chamber. The pump also has an annular pump chamber defined in part by the tube and the core above the lower end chamber. A feed passage in the tube connecting the lower end chamber to the annular pump chamber has a feed passage check valve oriented to open during each upward pumping stroke of the tube with the inlet check valve closed to deliver viscous liquid from the lower end chamber to the annular pump chamber. And, an outlet passage connected to the annular pump chamber permits viscous liquid to flow from the annular pump chamber to an outlet on each upward pumping stroke and each downward pumping stroke.

Other objects and features will be in part apparent and in part pointed out hereinafter.

BRIEF DESCRIPTION OF THE DRAWINGS

Corresponding reference characters indicate corresponding parts throughout the drawings.

DETAILED DESCRIPTION

Figure 1:
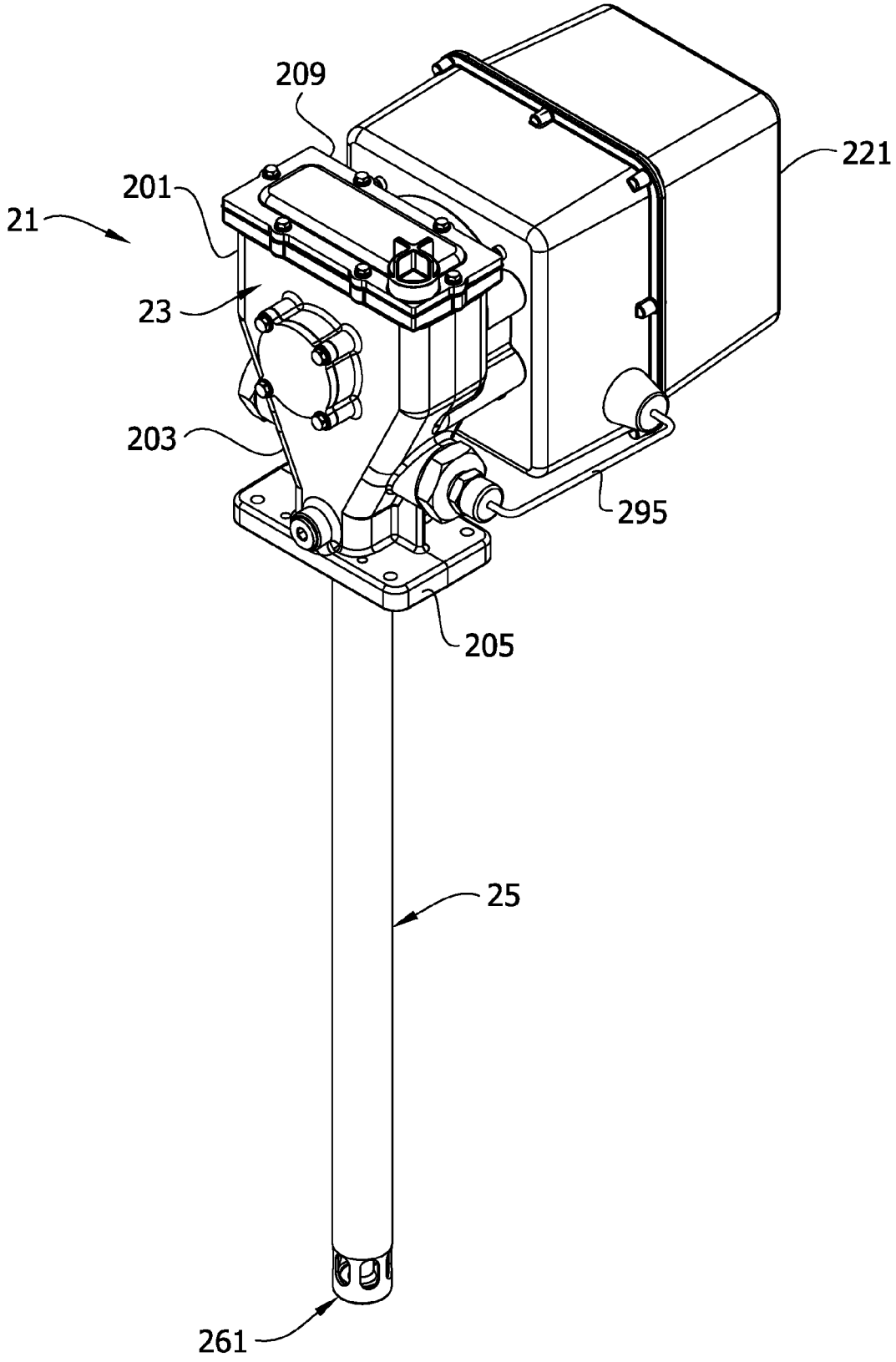
FIG. 1 is a perspective view of a lance pump of one embodiment of the present invention.
Figure 2:
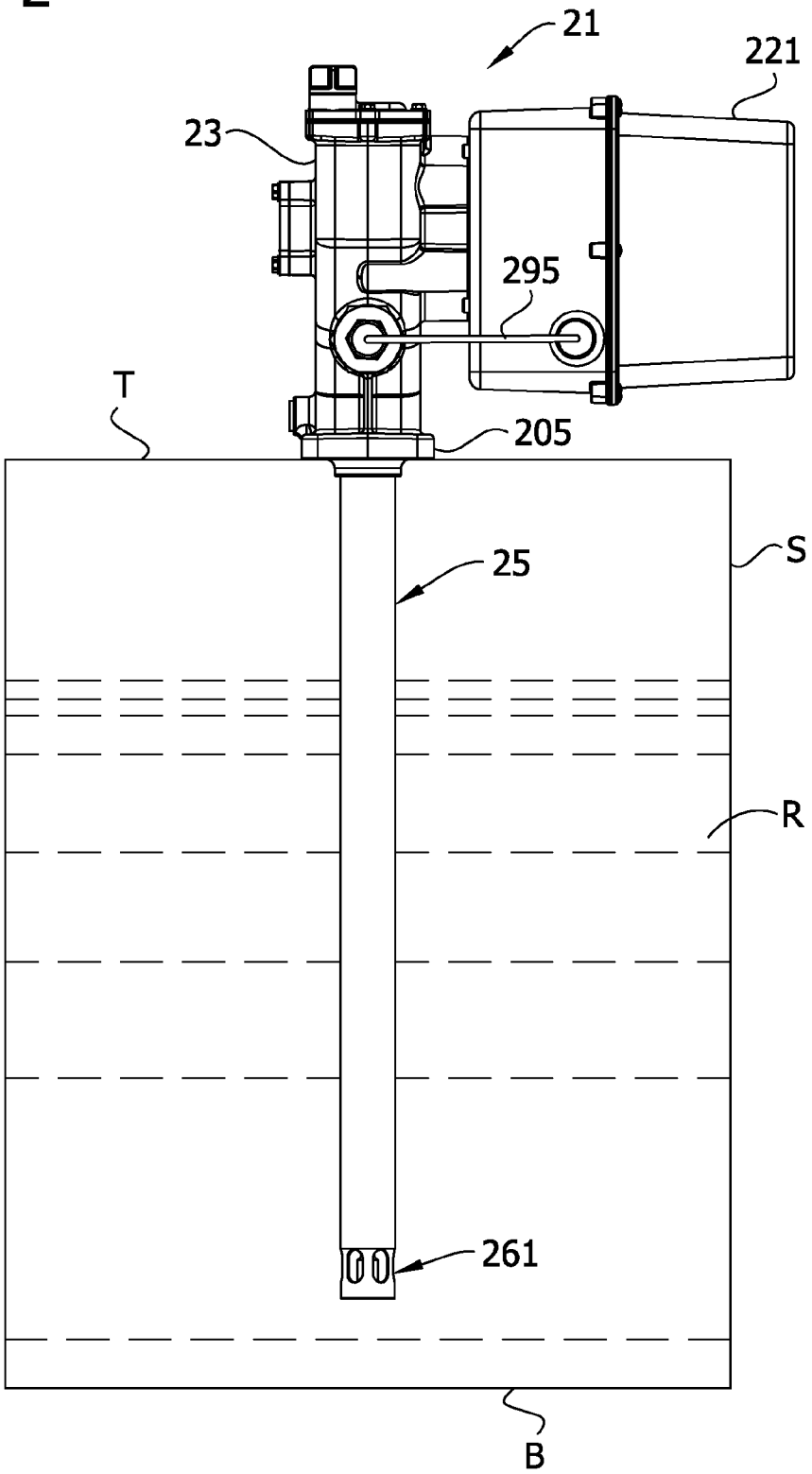
FIG. 2 is a side elevation of the lance pump mounted on a supply of lubricant.
Figure 3:
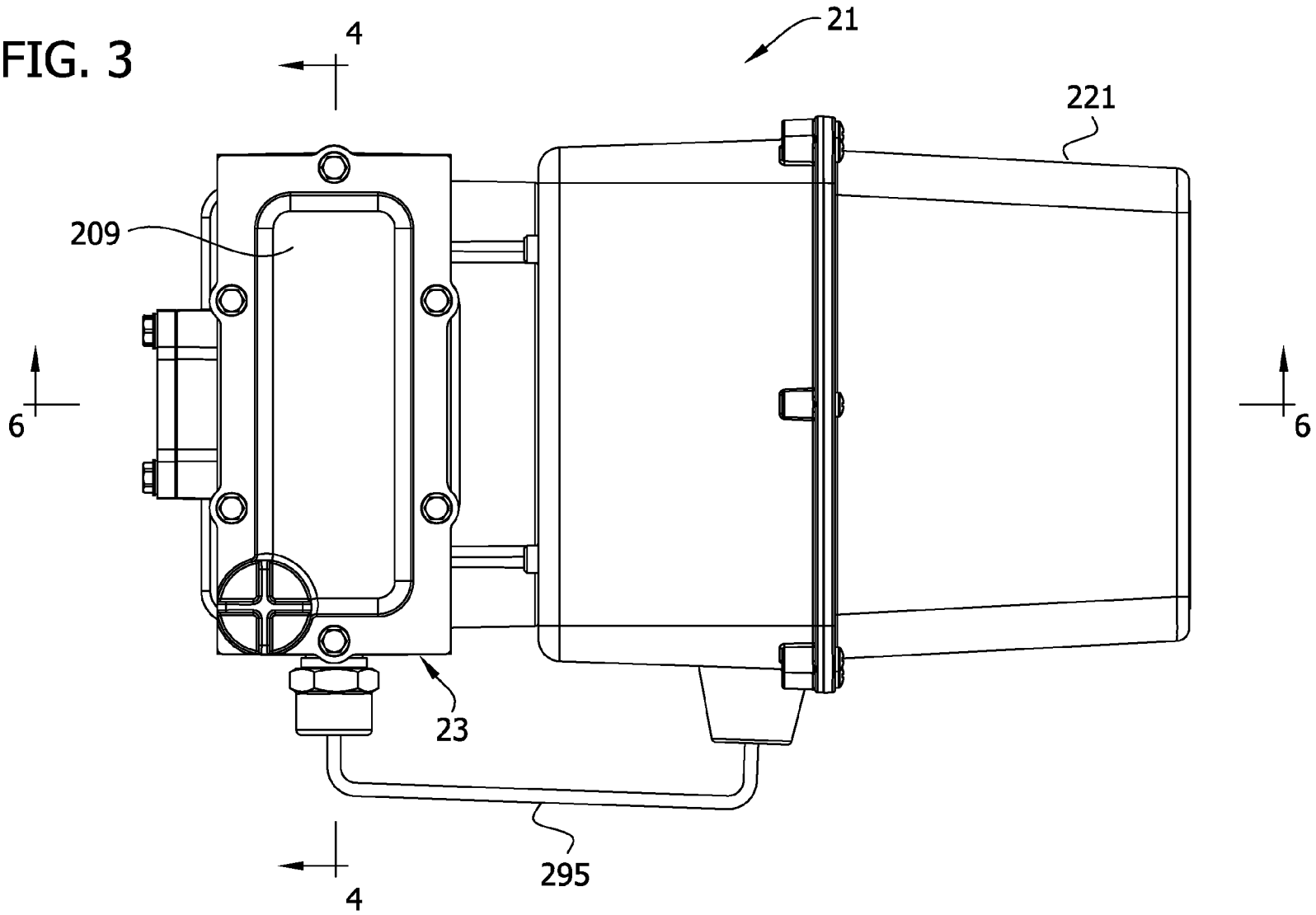
FIG. 3 is a top plan view of the pump in FIG. 1.

Referring to FIGS. 1 and 2, a lance pump or drum pump of the present invention, constructed particularly for pumping lubricant, especially grease, from a supply, is designated in its entirety by the reference number 21. The pump 21 comprises a hollow body, generally designated by 23, adapted for placement above the supply, and a lance structure 25 extending down from the body. The lance structure, generally designated by 25, is intended to extend into a supply of lubricant. As indicated in FIG. 2, the supply may be contained in a reservoir R, such as a drum, the body being mounted on the top or lid T of the drum with the lance structure 25 extending down into the drum toward the bottom B of the reservoir through a hole in the top. Although the pump 21 has been developed for pumping lubricant and especially grease, it is adapted to pump other pumpable products, particularly viscous liquids.

Figure 7:
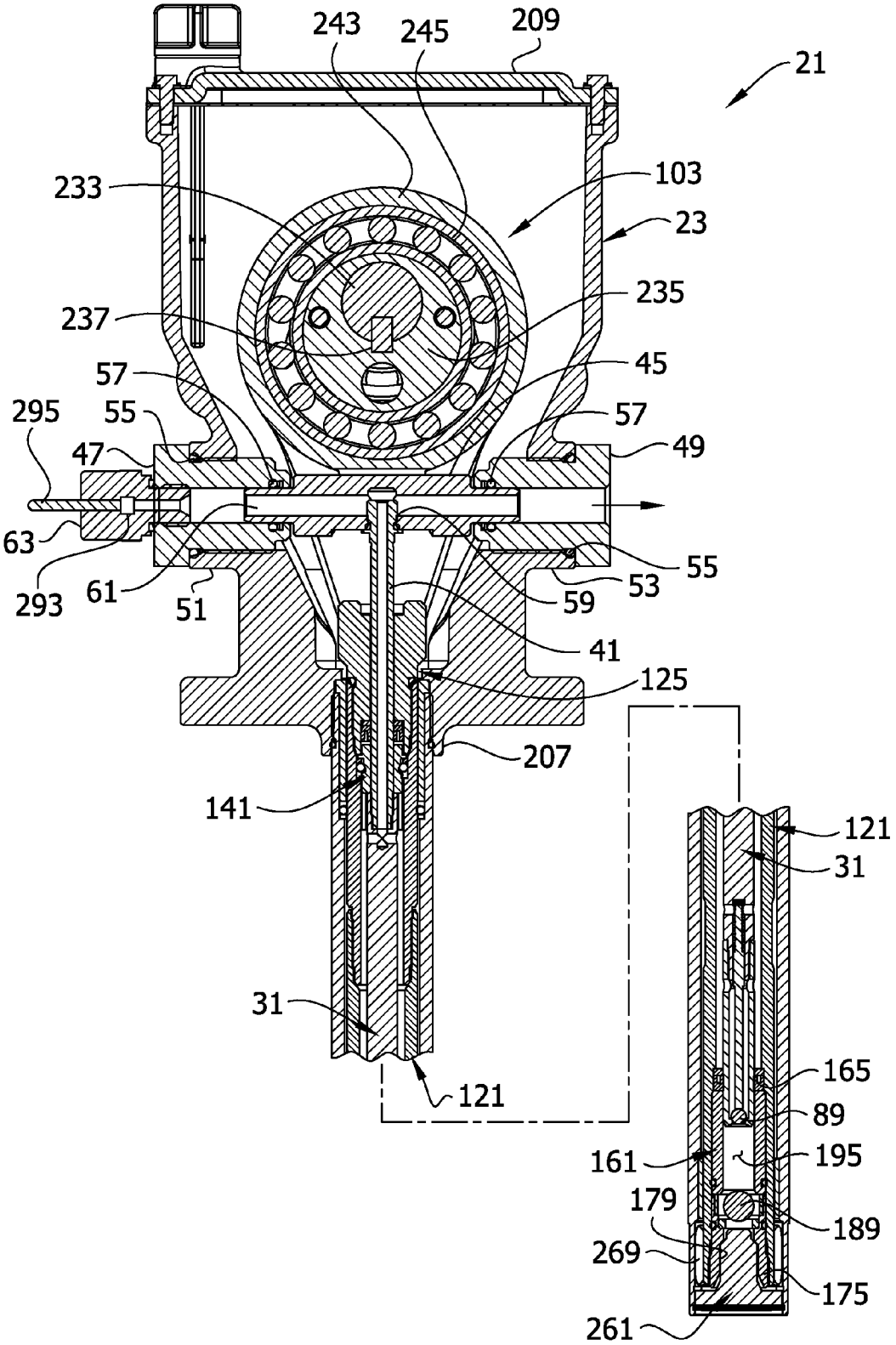
FIG. 7 is a view similar to FIG. 5 but showing the pump tube in a lowered position.
Figure 8:
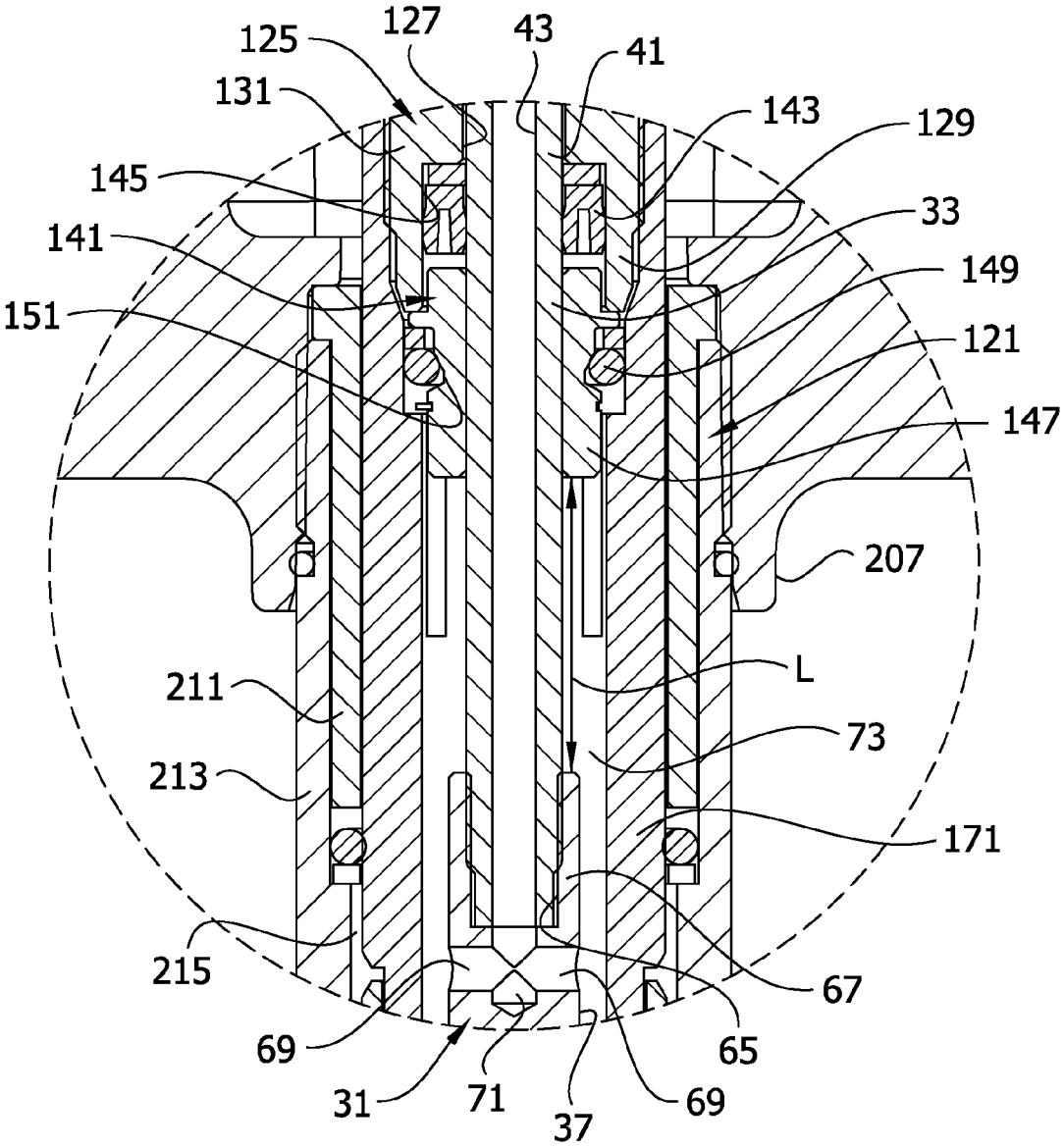
FIG. 8 is an enlarged view of a portion of FIG. 5 illustrating details.

In general, the basic construction and operation of the pump 21 is similar to that of the lance pump described in the previously mentioned U.S. patent application Ser. No. 13/331,249, which is incorporated by reference. In particular, referring to FIGS. 4-8, the pump 21 comprises an elongate member constituting a pump rod or core, designated in its entirety by the reference numeral 31 extending down from the body 23. The core 31 has an upper end portion 33, a lower end portion 35 and an intermediate portion 37. These portions 33, 35, 37 are co-linear on a vertical central axis of the lance structure 25. As shown in FIGS. 5 and 8, the upper end portion 33 of the core comprises a relatively short tubular element 41 having a bore 43 extending from its lower end to its upper end. The latter extends into a cross-pipe 45 extending across the body 23 and laterally with respect to the core 31. As will be apparent to those skilled in the art, the tubular element 41 and cross-pipe 45 act as an outlet. The cross-pipe 45 has reduced-diameter ends (FIG. 7) fixed in openings in tubular retainers 47, 49 threaded in tubular formations 51, 53 extending horizontally outward from opposite walls of the body 23. O-rings 55 are provided to seal the tubular retainers in the tubular formations 51, 53. As further shown in FIG. 7, O-rings 57 also seal the reduced-diameter ends of the cross-pipe 45 in openings in the tubular retainers 47, 49. The upper end of the tubular element 41 is fixed in a vertical opening 59 in the cross-pipe 45 extending up from the bottom of the cross-pipe. The opening 57 terminates below a top of the cross-pipe 45.

Figure 5:
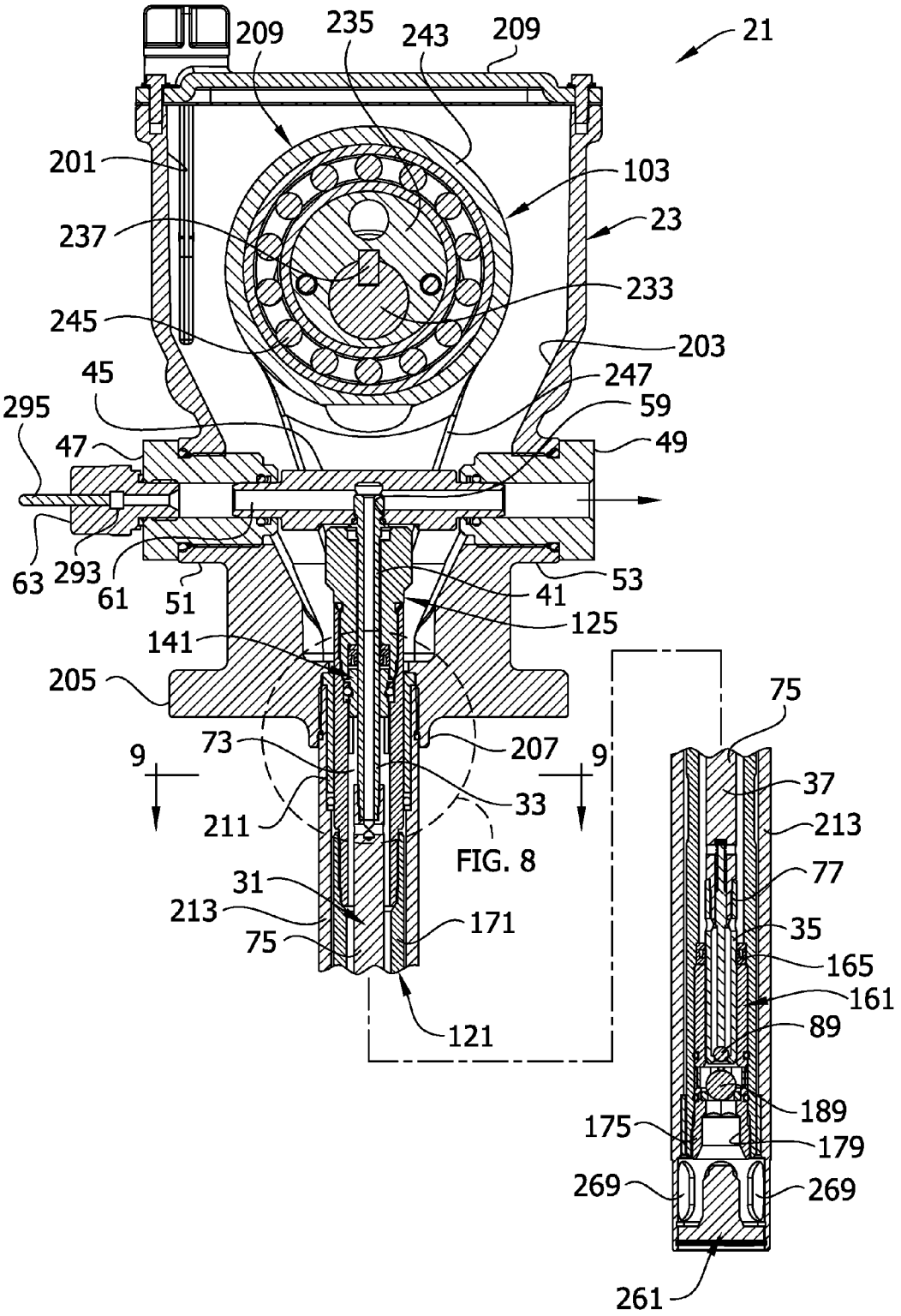
FIG. 5 is an enlarged view of portions of FIG. 4 showing a pump tube of the pump in a raised position.
Figure 6:
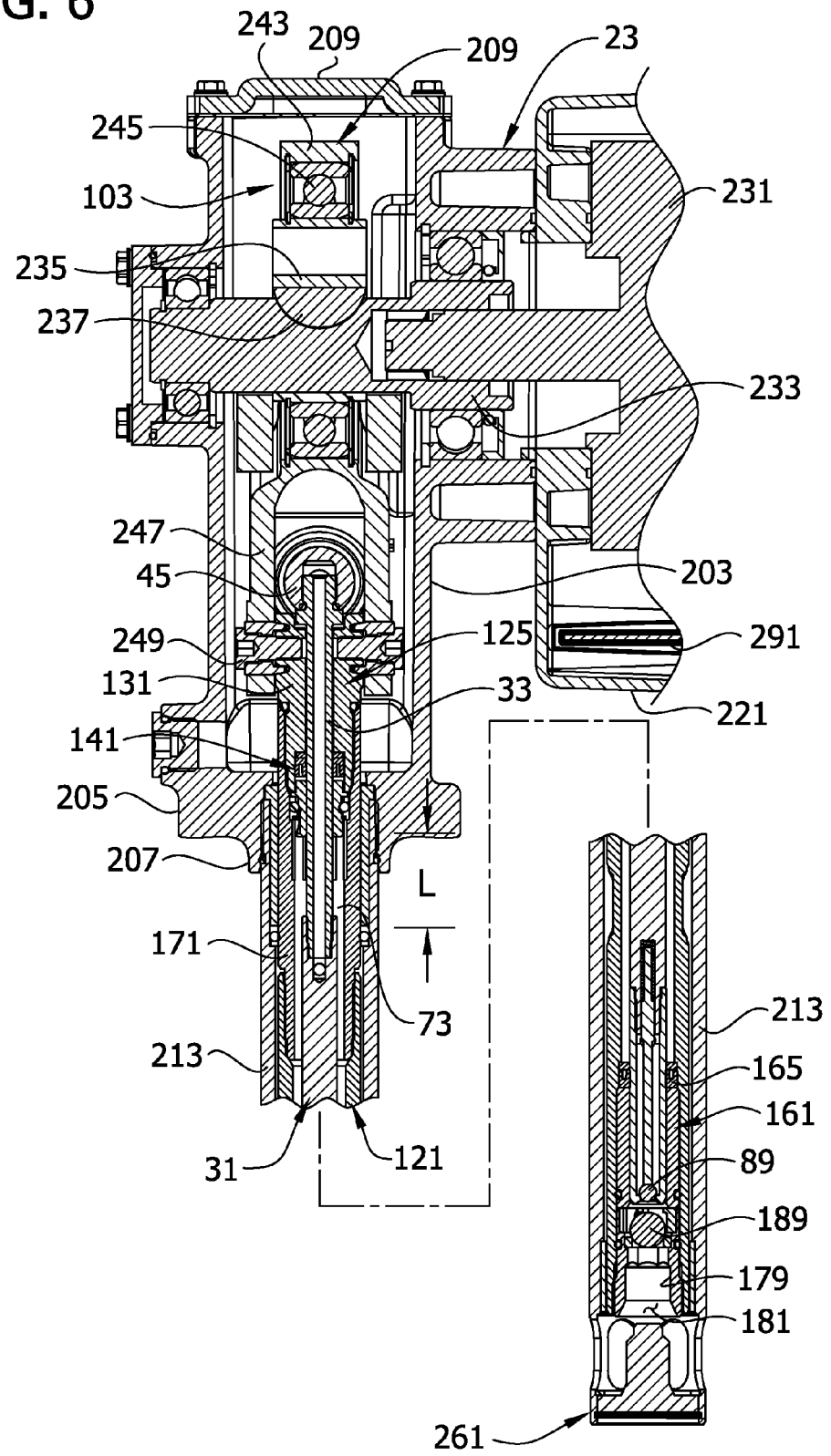
FIG. 6 is a view similar to FIG. 5 but taken in the plane of 6-6 of FIG. 3.
Figure 9:
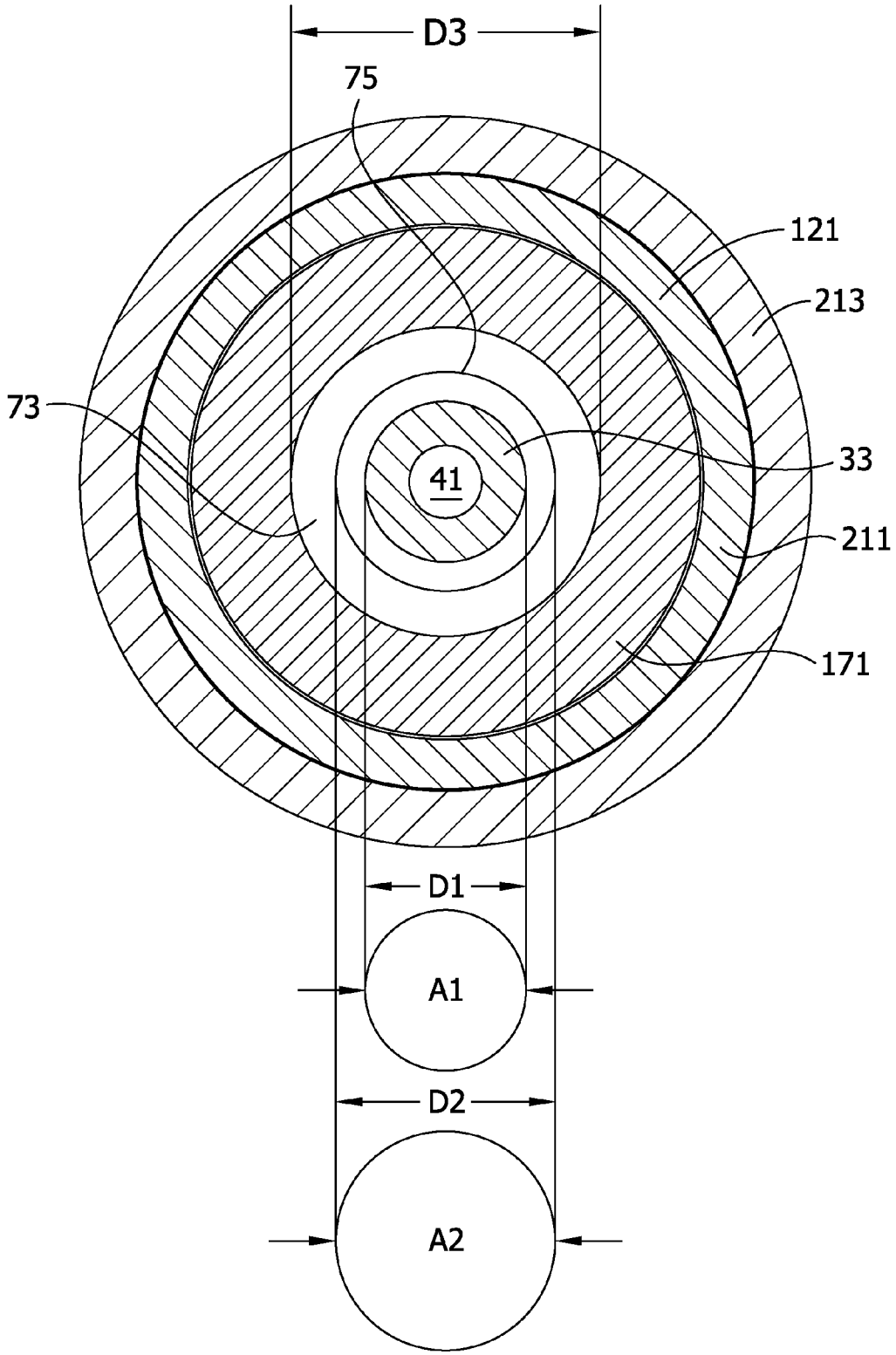
FIG. 9 is an enlarged horizontal section taken in the plane of lines 9-9 of FIG. 5.

As illustrated in FIGS. 5 and 6, the tubular element 41 has a flange engaging the bottom of the cross-pipe 45 and is sealed in the opening 59 by an O-ring. As will be understood by those skilled in the art, the bore 43 of the tubular element 41 opens at its upper end to a bore 61 of the cross-pipe 45, allowing product being pumped up through the bore of the tubular element to flow into the bore of cross-pipe and out of the bore of cross-pipe to the right as shown by the arrows in FIGS. 5 and 7. The left end of the cross-pipe 45 is blocked by a plug 63 capable of monitoring pressure as will be explained below. As shown in FIG. 9, the tubular element 41 has an outside diameter D1 and an overall cross-section area A1. As illustrated in FIG. 8, the tubular element 41 has a reduced-diameter lower end portion fixedly received in a cylindrical recess 65 in the upper end 67 of the intermediate portion 37 of the core 31. As the pump 21 operates, product enters the lower end of the bore 43 in the tubular element 41 and travels upward. The upper end 67 of the intermediate portion 37 of the core 31 has a short axial passage 71 extending down from a bottom of the recess 65 and lateral ports 69 just below the bottom of the recess 65 for communicating with a pump chamber 73 surrounding the intermediate portion 37 traveling to passage 71 and then to the outlet passage 43 in tubular element 41.

Figure 10A:
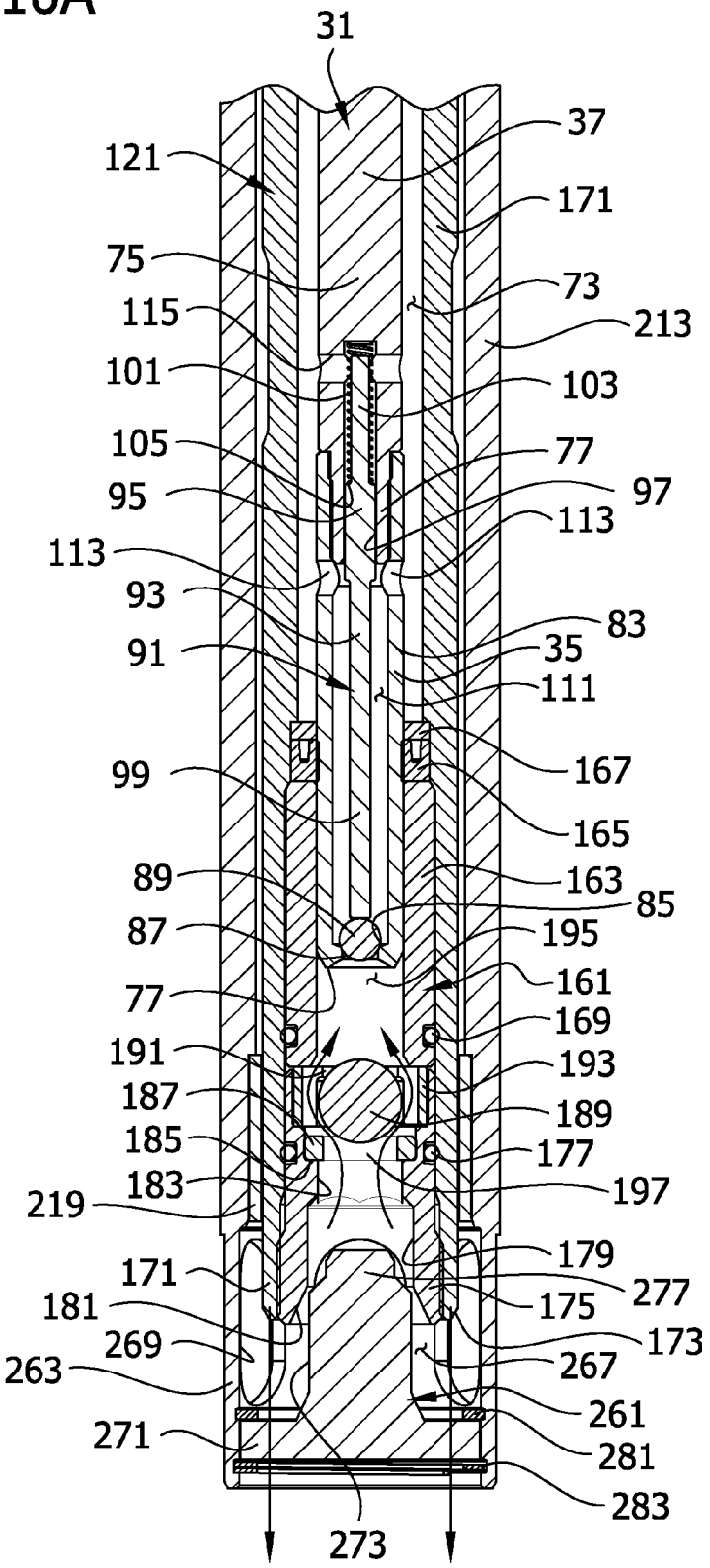
FIGS. 10A-10C are sequential views showing the lower end of the pump tube, a lance structure, and a ram on the lance structure as the pump tube moves between its raised and lowered positions during a downstroke and an upstroke of the pump tube.

Referring to FIGS. 5 and 10A, the intermediate portion 37 of the pump core 31 comprises an elongate solid cylindrical core member or rod 75 considerably longer than the tubular element 41. In one embodiment, the entire pump core 31 may measure about 19.15 inches from the upper end of the tubular element 41 to the lower end of the pump core 31, and the tubular element may measure about 4.0 inches from its upper end to the upper end at 67 of the elongate member 75. In the illustrated embodiment, the core member 75 has a uniform circular cross section with a diameter D2 (see FIG. 9) along most of its length, but has a reduced diameter lower end extension 77.

Referring to FIG. 10A, the lower end portion 35 of the pump core 31 comprises an elongate cylindrical sleeve 83 surrounding the lower end extension 77 of the solid core member 75 having essentially the same external diameter as the diameter D2 of the solid core member. Thus, the external surface of the pump core 31 along its intermediate portion 37 and lower end portion 35 has a uniform diameter D2 and a cross-sectional area A2 as shown in FIG. 9.

As illustrated in FIG. 10A, the sleeve 83 has an elongate cylindrical bore 85 extending axially from its lower end to its upper end. The bore 85 has a diameter corresponding to an outside diameter of the lower end extension 77 of the solid core member 75. The sleeve 83 is secured (e.g., by a threaded connection) at its upper end to the extension 77. The sleeve 83 has a length such that its lower end, constituting a lower end of the pump core 31, is spaced from the lower end of the extension 77. An inlet valve formed at a lower end of the sleeve 83 comprises a check valve seat 85 having a check valve port 87 (see FIG. 10A), which may be referred to as the inlet port. The inlet port also includes a check valve ball 89. The ball 89 is biased downward against the seat 85 by a check valve closer, generally designated 91, to close the port 87.

In the illustrated embodiment, the check valve closer 91 comprises a rod 93 having an upper portion 95 movably received in a bore 97 extending up from the lower end of the extension 77, and a lower portion 99 extending down into the sleeve 83 to engage the check valve ball 89. The upper portion 95 of the rod 93 has a close-clearance sliding fit inside the bore 97. A spring 101 seated in the bore biases the rod 93 downward to urge the check valve ball 89 against its seat 85. The spring 101 surrounds a reduced diameter extension 103 of the upper portion 95 of the rod 93 and reacts against a shoulder 105 on the rod. The lower portion 99 of the rod 93 has an outside diameter less than the inside diameter of the sleeve 83 to provide a passage 111 between the rod and the sleeve. The annular passage 111 allows lubricant to flow upward from the inlet port 87 to the upper end of the annular passage where lateral ports 113 in the sleeve 83 permit the lubricant to exit laterally from the passage. Thus, the annular passage 111 and the later ports 113 collectively constitute a feed passage connecting the lower end chamber 195 to the annular pump chamber 73. And, the check valve ball 89 and seat 87 constitute a feed passage check valve. A transverse bore 115 through the core 31 vents the bore 97 in the upper portion to the elongate annular pump chamber 73 surrounding the intermediate portion 37 of the pump core 31, allowing the rod 93 to move up and down in the bore 97. As will be appreciated by those skilled in the art, positioning the spring 101 in the bore 97 rather than in the annular passage 111 facilitates flow of lubricant through the passage to the lateral ports 113.

Figure 4:
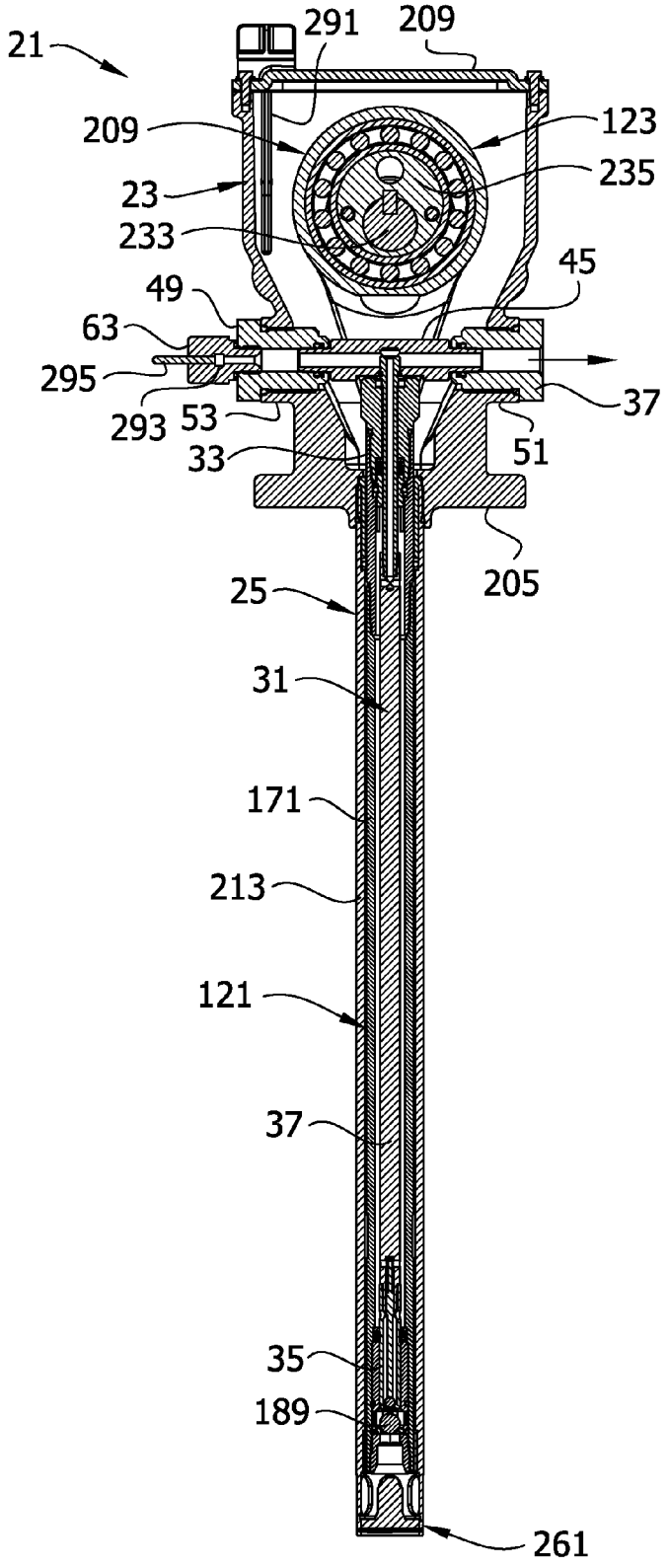
FIG. 4 is a vertical section taken in the plane of lines 4-4 of FIG. 3.

Referring to FIG. 4, an elongate pump tube 121 surrounds the pump core 31 and extends down from a position adjacent the upper end of the pump core. A motor-driven transmission indicated generally at 123 is mounted on the body 23 for reciprocating the pump tube 121 through a pump stroke. The transmission 123 reciprocates the pump tube 121 between a raised position relative to the fixed pump core 31 as illustrated in FIGS. 5, 6, and 8, and a lowered position relative to the pump core as illustrated in FIG. 7. The pump tube 121 moves toward the raised position during an upstroke and moves toward the lowered position during a downstroke.

By way of example, in one embodiment the pump core 31 is about 19.15 inches long and has a diameter D1 of about 0.275 inch and a diameter D2 of about 0.390 inch. The pump tube 121 is about 18.8 inches long, and has an internal diameter of about 0.562 inch. In this example, the pump stroke, indicated at S in FIGS. 6 and 8, is about 0.75 inch.

Referring to FIGS. 5-8, the pump tube 121 has an upper end closure, generally indicated by 125, that is slidable up and down on the upper end portion 33 of the pump core, i.e., on the tubular element 41. This upper end closure 125 has a bore 127 dimensioned to slidingly receive the tubular element 41 (see FIG. 8). The upper end closure 125 has a lower portion or stem 129 fixedly fitted in the upper end of the pump tube 121 and an upper body portion 131 on the stem.

As shown in FIG. 8, a double seal, generally designated by 141, is positioned adjacent the upper end closure 125 for sealing the upper end of the pump tube 121. The double seal 141 includes an upper seal 143 positioned in a bore 145 extending up from the lower end of the stem 129 of the closure 125. The upper seal 143 surrounds the tubular element 41 of the core 31 and seals against the stem 129 and the tubular element. In the illustrated embodiment, the upper seal 143 is a cup seal that slides on the tubular element 41. The double seal 141 also includes a metal bushing 147 around the tubular element 41 below the stem 129 of the upper end closure 125. A lower seal 149 carried by the bushing 147 seals against the pump tube 121 below the upper seal 143. In the illustrated embodiment, the lower seal 149 is an O-ring seal seated in an annular groove 151 in the outer surface of the bushing 145. It is envisioned that other double seal arrangements may be used without departing from the scope of the present invention.

As illustrated in FIG. 10A, the pump tube 121 has a lower closure, generally designated by 161, slidably mounted on the lower end portion 35 (sleeve 83) of the pump core 31 that closes the pump tube above its lower end. The lower closure 161 includes a generally cylindrical tubular member 163 fixedly mounted in the pump tube 121 just above the lower end of the pump tube. An elastomeric ring 165 is provided at the upper end of the closure 161. The ring is held on the closure 161 by a retainer 167. The ring 165 surrounds the sleeve 83 so it slidingly seals against the sleeve. In one embodiment, the ring 165 is a cup seal having a U-shaped cross section in a longitudinal plane. An O-ring seal 169 surround the lower portion of the tubular member 163. The pump tube 121 has a larger internal diameter D3 and a larger internal cross-sectional area than the pump core 31 along its entire length between the upper and lower end closures 125, 161, respectively, defining the aforementioned pump chamber 73. The pump chamber 73 extends between the surface of the fixed pump core 31 and the interior surface of the pump tube and from the upper closure to the lower closure. The pump tube 121 is longer than the pump core 31 and extends down below the lower end 75 of the pump core whether in its lowered or raised positions. In one embodiment, the pump tube 121 has a larger internal cross section along its entire length than the intermediate or lower portions 37, 35 of the pump core 31.

The pump tube 121 comprises an elongate tubular member 171 extending, in its raised position shown in FIGS. 5, 6, and 8, all the way down from its upper end closure 125 to a lower end 173 below the lower closure 161. A tubular cylindrical check valve fitting 175 is positioned in the lower end portion of the tubular member 171. This fitting 175 is held in the lower portion of tubular member 171 by an O-ring seal as indicated at 177 and extends below the lower end 173 of member 171. The fitting 175 has a passage 179 extending up from an opening 181 at its lower end. The passage 179 has a hexagonal throat 183 forming an upward facing annular shoulder 185. An annular valve seat 187 for a ball check valve 189 constituting an inlet check valve (see FIG. 10A) is mounted on the shoulder 185. The valve seat 187 and the ball 189 occupy an upwardly opening recess 191 in the upper end of the fitting 175. The ball 189 is captured in the recess 191 by an internally ribbed retainer 193 fixed on the upper end of the fitting 175. The ball retainer 193 is formed as shown in FIG. 10A to allow the ball 189 to move up off the ball seat 187 providing for flow of lubricant up around the ball to a space 195 in the pump tube 121 below the lower end 75 of the fixed core 31. The space 195 constitutes an expansible and contractible lower end chamber. A central opening 197 in the ball seat 187 has an area at least 70% of the cross-sectional area of the pump core 31 at its lower end 75 (i.e., at least 70% of area A2) to reduce a pressure drop across the seat 187.

Referring to FIG. 5, the body 23 has an upper portion 201 of generally rectangular shape in horizontal section and a lower portion 203 tapering down toward its lower end where it has an outwardly extending flange 205 serving as a base for mounting the body on the top T of a drum R (see FIG. 2) containing lubricant with the lance structure 25 of the pump 21 extending down through a hole in the top toward the bottom B of the drum. The body 23 further has a bottom part 207 having a central circular opening. The body 23 is closed at the top by a top plate 209 secured to the upper portion of the body such as by screw fasteners.

The pump tube 121 extends down from inside the tapered lower portion 203 of the body 23 and through the bottom part 207. The pump tube 121 is slidably received in a bronze bushing 211 provided in the upper end of an elongate tubular casing 213 forming part of the lance structure 25. The casing 213 extends all the way down the lance structure 25 from the body 23 to a level just above the lower end 173 of the pump tube 121 when the pump tube is in its raised position as illustrated in FIGS. 5 and 8. The casing 213 has a larger internal diameter than the external diameter of the pump tube 121 as shown in FIG. 8 so there is an elongate annular space 215 between them. As shown in FIG. 10A, the pump tube 121 (more particularly the elongate tubular member 171) is sealingly slidable in a bronze bushing 219 fixed in the lower end of the tubular casing 213. The bushing 219 guides the pump tube 121, and acts as a seal that prevents lubricant from entering the space 215 between the pump tube 121 and the casing 213.

Referring to FIGS. 1-3 and 6, housing 221 is mounted on a side wall of the body 23. As shown in FIG. 6, a motor 231 such as a servo motor or a stepper motor is mounted inside the housing 221. The stepper/servo motor 231 has a rotary output shaft 233 extending horizontally across the body. The transmission 123 for reciprocating the pump tube 121 up and down through its pump stroke S comprises a rotary-to-reciprocating mechanism interconnecting the rotary output shaft 233 and the upper end of the pump tube 121. As illustrated in FIGS. 5 and 6, this mechanism comprises an eccentric 235 joined to the shaft 233 by a key 237 so it rotates with the shaft. The eccentric 235 comprises a circular disk eccentrically mounted on the shaft 233. Although other motors may be used without departing from the scope of the present invention, in one embodiment the motor 231 is a Nema Frame Stepper Motor available from Anaheim Automation of Anaheim, Calif. The rotary-to-reciprocating mechanism further comprises a follower 241 including a ring 243 mounted on a ball bearing 245 surrounding the eccentric 235. A yoke 247 extending from the ring 243 straddles the cross-pipe 45. A pin 249 connects the yoke 247 to the upper end of the body portion 131 of the upper end closure 125 of the pump tube 121. As will be appreciated by those skilled in the art, when the eccentric 235 rotates through each revolution, the follower 241 is raised and lowered (it also oscillates back and forth as permitted by the pin 249) to reciprocate the pump tube 121 linearly up and down through the pump stroke S. Further, the length of the pump stroke S is determined by the throw of the eccentric 235 (e.g., 0.75 inch).

In one embodiment, the outside diameter D2 of the intermediate and lower portions 37, 35 of the pump core 31 is greater than the outside diameter D1 of the tubular element 41 (i.e., the upper end portion of the pump core 31). Further, the overall cross-sectional area A2 of the intermediate and lower portions 37, 35 of the pump core is greater than the overall cross-sectional area A1 of the tubular element 41 (see FIG. 9). More specifically, in one embodiment the area A2 is twice as large as area A1 (e.g., D2 may be about 0.390 inch, D1 may be about 0.275 inch, area A2 being about 0.120 square inches and area A1 being about 0.060 square inches.)

In one embodiment, a ram, generally designated 261, is provided at a lower end of the lance structure 25 for forcing lubricant up into the lower end of the pump tube 121 past the inlet check valve 191 on a downstroke of the pump tube 121. As illustrated in FIGS. 10A-10C and 11, the tubular casing 213 of the lance structure 25 has a tubular wall 263 at its lower end extending below the lower end of the pump tube 121. This tubular wall 263 defines an inlet chamber 267 for receiving pumpable product from the supply of lubricant R. The wall 263 has at least one large opening 269, and desirably multiple large openings to allow pumpable product to flow freely from the supply into the inlet chamber 267.

Figure 11:
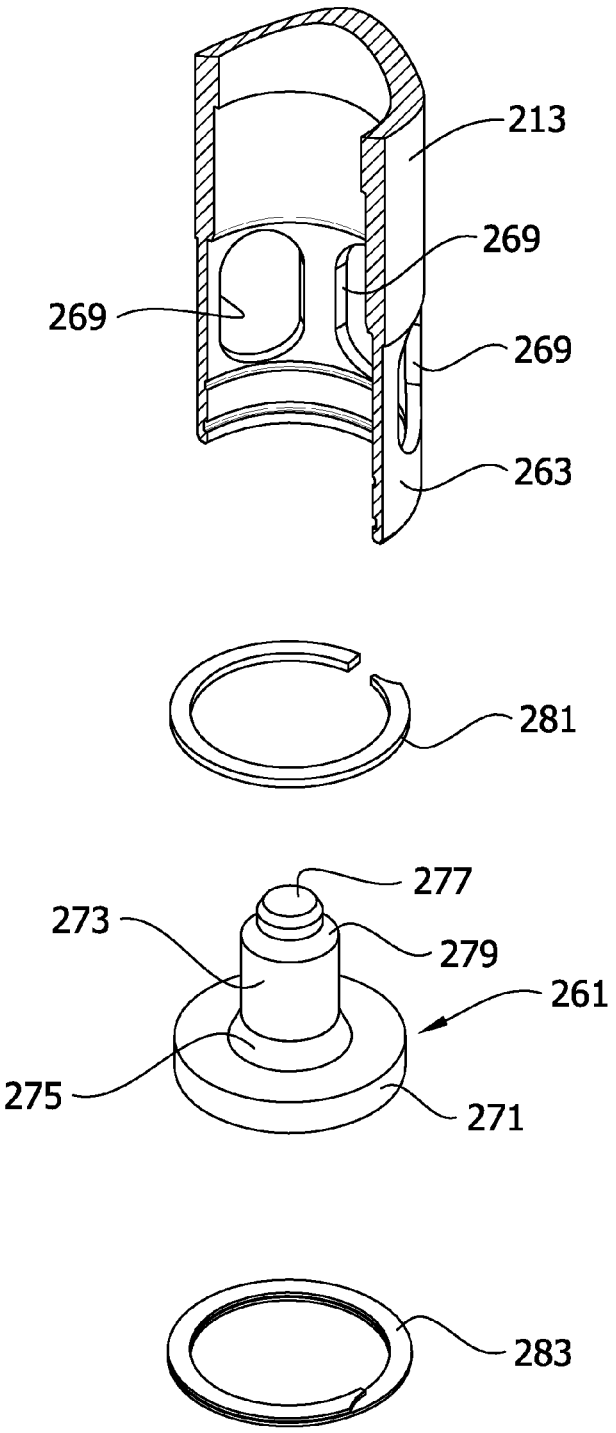
FIG. 11 is a separated perspective showing a lower end section of the lance structure, the ram, and related components.

Referring to FIGS. 10A and 11, the ram 261 is positioned inside the inlet chamber 267 defined by the tubular wall 263. The ram 261 comprises a generally circular base 271 dimensioned to fit closely inside the wall 263. The ram 261 also includes a generally cylindrical body 273 having a tapered lower portion 275 connecting the body to the base 271, and a generally cylindrical body 277 of reduced diameter connected to the body by an inclined upward-facing shoulder 279.

Figure 10B:
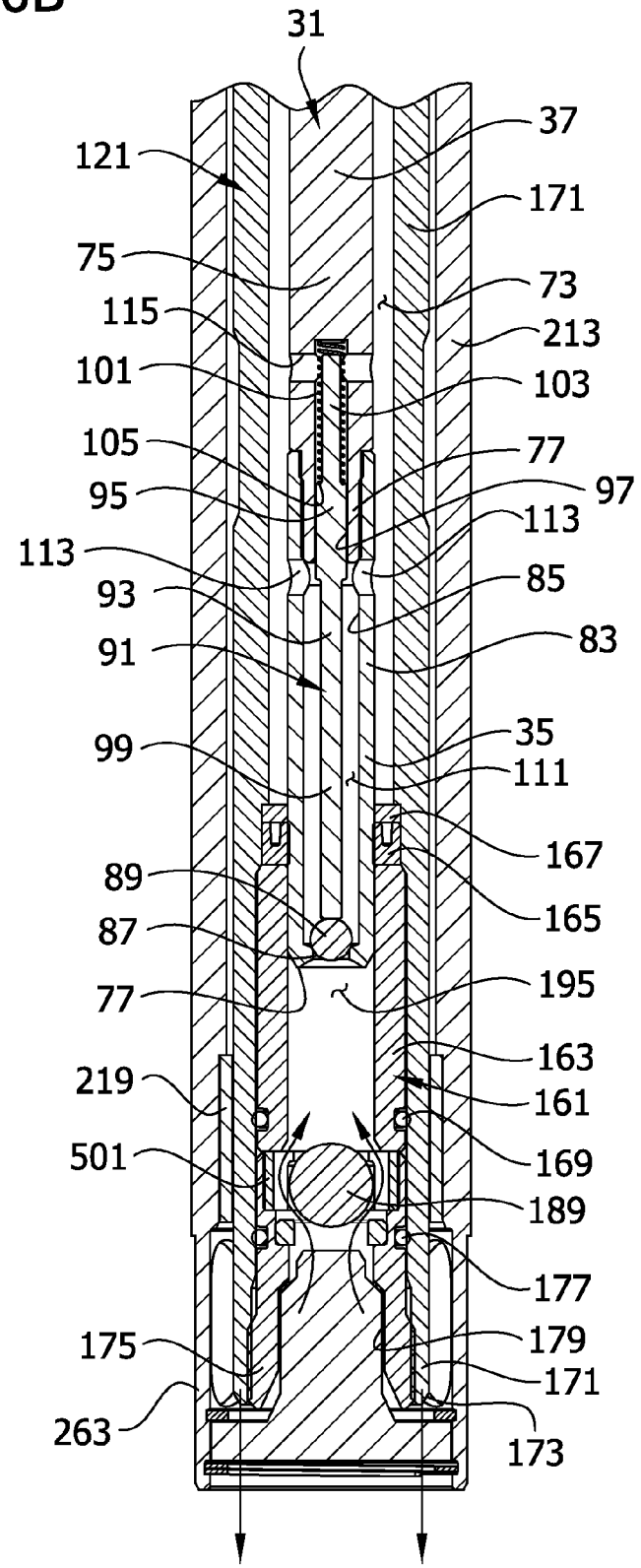

The ram 261 is sized and shaped such that when the pump tube 121 is in its raised position as shown in FIGS. 5 and 6, lubricant is free to flow from the supply R into the inlet chamber 267, into the space surrounding the body 273 and body 277 of the ram 261, and then upward past the body 277 into the passage 179 of the check valve fitting 175 to fill the space below the inlet ball check valve 191. The ram 261 is further sized and shaped such that when the pump tube 121 is in its lowered position as shown in FIGS. 7 and 10B, the generally cylindrical body 273 of the ram 261 has a relatively close circumferential fit in the passage 179 of the check valve fitting 175, and the body 277 of the ram has a looser circumferential fit in the throat 183 of the passage 179. The upward-facing shoulder 279 of the ram is contoured to engage the downward-facing shoulder 175 in the passage 179 immediately below the throat 183. As illustrated, the ram 261 is integrally formed as a single part, but it will be understood that that it may comprise separate parts. Other ram configurations are also possible.

Referring again to FIGS. 10A-10C and 11, the ram 261 is held in position in the lower end section 263 of the tubular casing 213 by an upper retaining ring 281 overlying the base 271 of the ram and by a lower retaining ring 283 underlying the base. The retaining rings 281, 283 have outer peripheral edges received in annular grooves in the lower end section 263 of the casing 213. Desirably, the lower retaining ring 283 is a resiliently compressible helix ring that holds the ram 261 tightly between the two rings 281, 283 to prevent the ram from rattling. If necessary or desired, the ram 261 can be removed from the pump casing 213 by removing the lower retaining ring 283. As further illustrated in FIG. 6, a control 291 is housed inside the housing 221 for controlling operation of the stepper/servo motor 231. In particular, the control 291 is a microprocessor custom made by Lincoln Industrial Corporation of St. Louis, Mo., and adapted to control a speed and direction of rotation of the output shaft 233 of the motor 231. As will be appreciated by those skilled in the art, the control 291 operates to change the flow rate of lubricant being pumped from the supply R. A pressure transducer 293 (broadly, a pressure monitor) mounted in the plug 63 is operatively connected by an electrical lead 295 to the control 291. In one embodiment, the transducer is a No. 846F-A-6000-00 available from Hydac Technology Corporation of Bethlehem, Pa. The transducer 293 communicates with the bore 61 of the cross-pipe 45 to measure pressure in the bore. When pressure of fluid in the bore 61 is outside a predetermined range, the control 291 adjusts the speed of the motor 231 to adjust the flow rate of lubricant being pumped and thereby adjust the pressure of fluid in the bore 61 of the cross-pipe 45. For example, when the pressure falls below the predetermined range, the control 291 increases the speed of the motor 231 to increase the flow rate of lubricant, thereby increasing the pressure of fluid in the bore 61 of the cross-pipe 45. Although the control 291 may operate to maintain the pressure of lubricant in the bore 61 to be within other predetermined ranges, in one embodiment the control maintains the pressure to be within a range of about 1000 psi to about 3500 psi. As will be appreciated by those skilled in the art, the control 291 can control system pressures to be within good design limits.

The pump 21 is operable in cycles, each cycle occurring on a revolution of the eccentric 235. Each cycle, which may be regarded as starting with the pump tube 121 in its uppermost raised position at the upper end of its stroke S shown in FIGS. 5, 6, and 8 as a result of the eccentric being at that point in its revolution where its high point is uppermost and its low point is down. With the pump tube 121 in its raised position, the double seal 141 of its upper end closure 125 is in the raised position as illustrated in FIGS. 5, 6, and 8, a distance approximately equal to or somewhat greater than the distance S above the upper end 67 of member 73, and the seal 155 of its lower closure 151 is in the raised position as shown in FIGS. 5 and 6, a distance greater than S above the lower end 75 of the core 31. The chamber 115 is fully charged with lubricant as a result of the preceding cycle (as will be described). The inlet check valve ball 191 is in its fully raised position in close proximity to the lower end 75 of the core and the lower chamber 197 is in its fully contracted state. As illustrated in FIGS. 5 and 6, the ball check 89 is closed. The passage 111 is full of lubricant, and the check valve ball 89 is in its closed position on the seat 85 as illustrated in FIGS. 5 and 6. On rotation of the eccentric 235 from its FIG. 5 position, the pump tube 121 is driven downward, its lower end including the check valve fitting 165 plunging down into the lubricant in the drum R. As illustrated in FIG. 7, the chamber 197 expands and the check valve ball 191 opens allowing entry of lubricant to fill the chamber 197 as it expands and creating a suction for drawing lubricant into the chamber 197. The check valve ball 89 remains closed.

As the pump tube is driven down through its downstroke, a portion of the tubular element 41 (constituting the upper end portion of the core 31) equal in length to that of the pump stroke S is withdrawn from the pump chamber 73 and a portion of the lower end portion of the core equal in length to the pump stroke S enters in the pump chamber. Thus, a volume equal to the pump stroke S times the cross-sectional area A1 of the tubular element 41 (S×A1) is withdrawn from the pump chamber 73 and a volume equal to the pump stroke times the cross-sectional area A2 of the lower end portion of the core (S×A2) enters in the pump chamber. As a result, a volume of lubricant equal to S×A2 minus S×A1 is delivered through the passage 43 in tubular element 41 to the outlet pipe 45. Because A2 equals 2×A1, the volume discharged from the pump chamber 73 equals S×A1 (i.e., the length of the pump stroke S times the cross-sectional area A1 of the upper end portion 33 of the core 31).

As the eccentric 235 rotates through the first half of a revolution from its FIG. 5 position to its FIG. 7 position, the pump tube 121 moves down through its downstroke. As the pump tube moves down relative to the stationary lance structure, the lower end of the pump tube moves down through the lubricant in the inlet chamber 267 defined by the lower end section 263 of the tubular casing 213, and the ram 261 moves up into the lower end of the pump tube to push lubricant from the inlet chamber up into the pump tube and past the inlet check valve 191 into the lower chamber 197. The downward movement of the pump tube 121 and the upward movement of the ram 261, particularly in the case where the lubricant is relatively stiff (e.g., a thick heavy viscous grease), expedites the loading of the lower chamber 197 which, at the lower end of the downstroke of the pump tube is expanded fully as shown in FIGS. 7 and 10B and completely filled with lubricant.

Figure 10C:
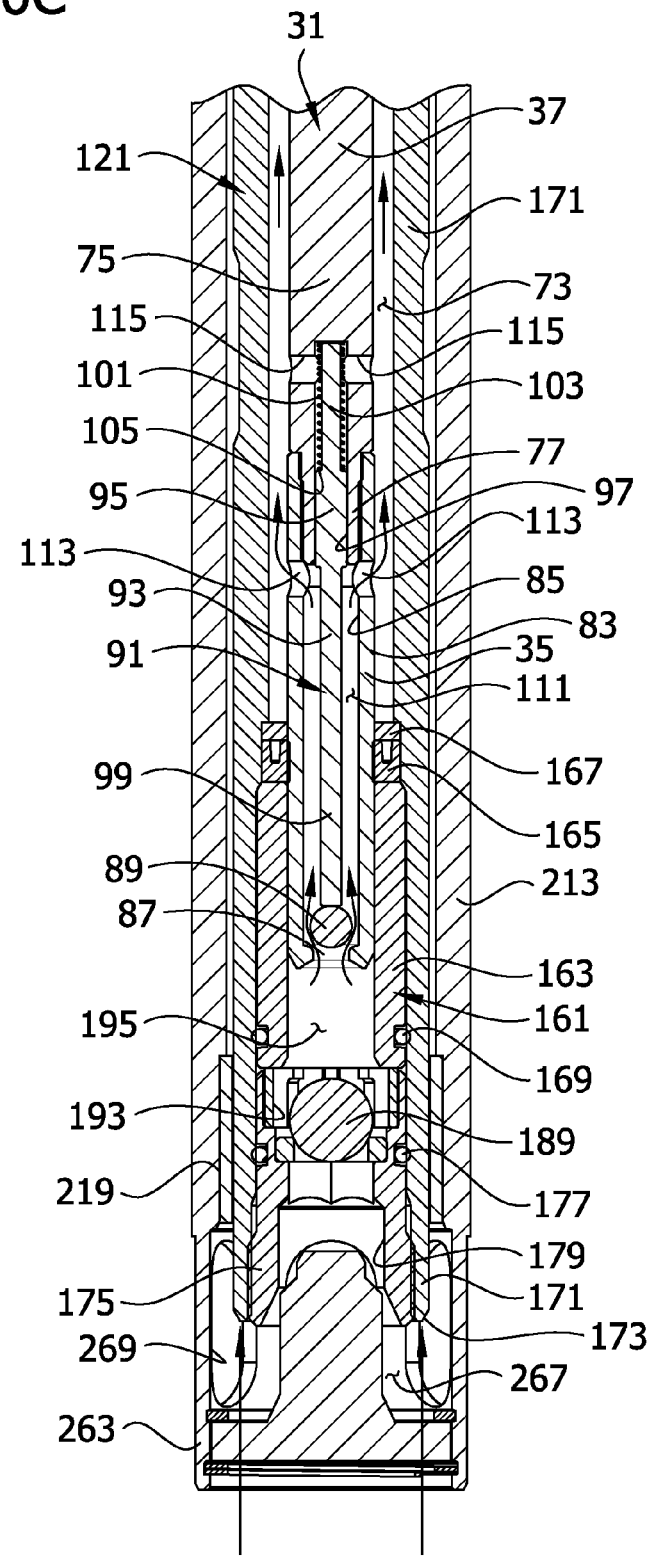

As the eccentric 235 rotates through the second half of a revolution, i.e., from the point where its high point is down and its low point is up as shown in FIG. 7 back to the point where its high point is up and its low point is down as shown in FIG. 5, it pulls the pump tube 121 back up through an upstroke having the length of the pump stroke S. As the pump tube 121 moves up, the lower check ball 191 closes, and lubricant is forced up from the chamber 197, opening the check valve 89 as shown in FIG. 10C, and lubricant is delivered from chamber 197 through passage 111 and ports 113 to the pump chamber 73. Also, as the pump tube 121 moves up, a portion of the length of the tubular element 41 (constituting the upper end portion of the core 31) equal to the stroke S re-enters the pump chamber 73 and a portion of the length of the lower end portion of the core 31 equal to the stroke S is withdrawn from the pump chamber. Thus, a volume equal to the pump stroke length S times the cross-sectional area A1 of tubular element 41 (S×A1) enters the pump chamber 73. In addition, a volume equal to S×A2 is transferred from the chamber 197 to the pump chamber 73 through the passage 71 so a volume of lubricant equal to S×A2 minus S×A1 is delivered through the passage in tubular element 41 to the outlet pipe 45. Because A2 equals 2×A1, the volume discharged from the pump chamber equals S×A1 (the same as on a downstroke). The chamber 197, which may be referred to as the intake chamber, is at least 85% exhausted on the upstroke, i.e., it is unswept no more than 15%, which is beneficial when grease having entrained air is being pumped. With the intake chamber 197 unswept less than 15%, reduction of pump output that might otherwise be caused because of entrained air is avoided.

Providing the same amount of lubricant during each stroke enables the pump to be used to meter predetermined measured quantities of lubricant. For example, if particular circumstances necessitate delivering a quantity of lubricant equal to that delivered by one stroke of the piston rod 65, the control 291 signals motor 115 to drive the piston rod through one stroke. If twenty times that quantity is desired, the control signals the motor to operate through twenty strokes to deliver the increased amount.

Upward movement of the pump tube 121 also results in movement of the ram 261 out of the passage 169 of the check valve fitting 197, toward the position shown in FIGS. 5 and 6, in which lubricant is free to flow from the supply R into the inlet chamber 267. This flow is facilitated by the relatively large open area provided by the openings 269 in the tubular wall 265 of the lower end section 263 of the casing 213.

Figure 12:
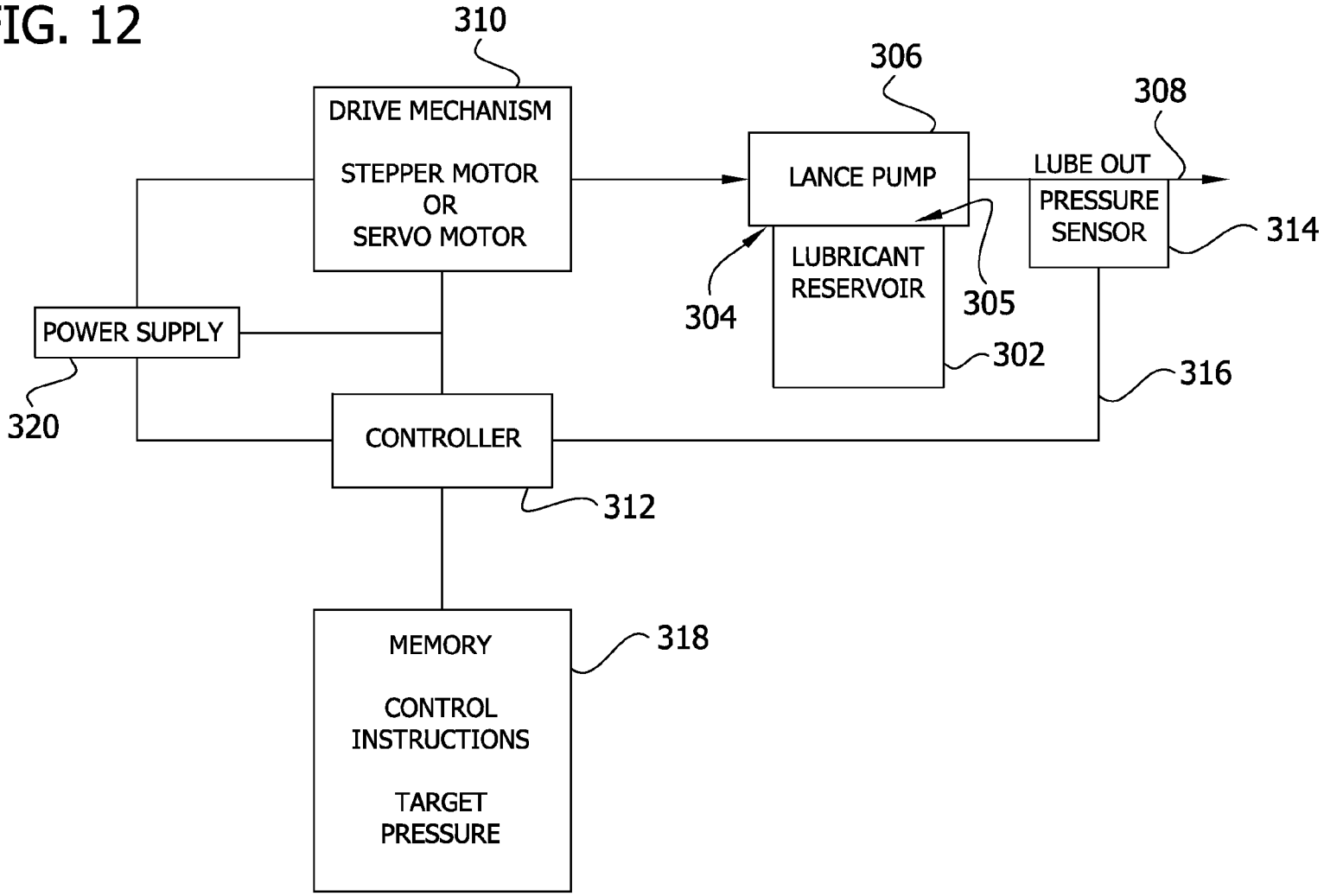
FIG. 12 is a block diagram illustrating a controller controlling a motor such as a servo motor or a stepper motor driving a lance pump according to one embodiment of the invention.
Figure 13:
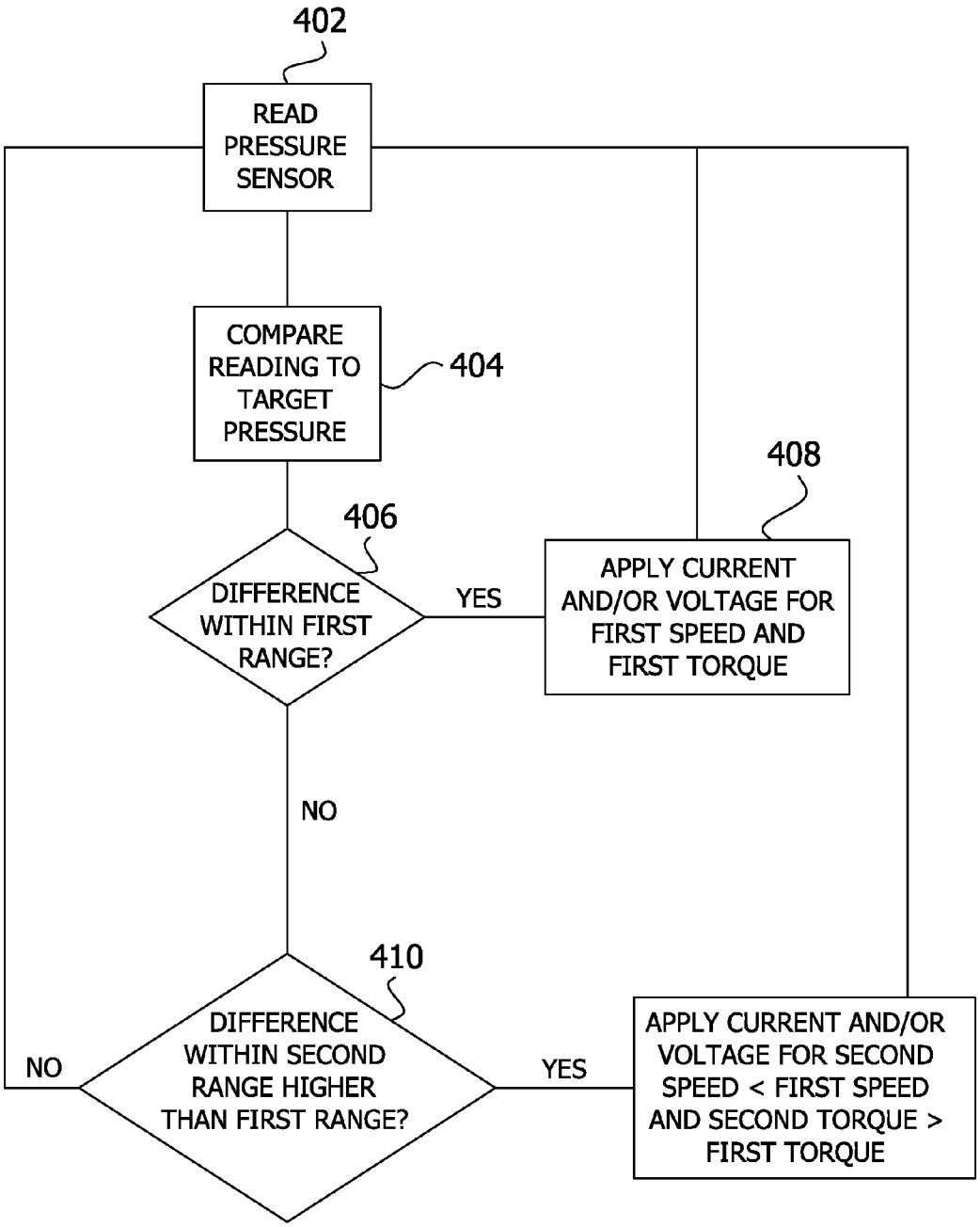
FIG. 13 is a flow chart illustration operation of a controller controlling a motor such as a servo motor or a stepper motor driving a lance pump according to one embodiment of the invention.

FIG. 12 is a block diagram illustrating a controller controlling a motor such as a servo motor or a stepper motor driving a lance pump according to one embodiment of the invention. FIG. 13 is a flow chart illustration operation of a controller controlling a motor such as a servo motor or a stepper motor driving a lance pump according to one embodiment of the invention.

A reservoir 302 holds lubricant and has a reservoir outlet 304 in communication with an input 305 to a lance pump 306, which has an output 308 in communication with a system (not shown) requiring lubricant. A drive mechanism 310 includes a motor such a stepper motor or a servo motor for driving the lance pump. A controller 312 controls the operation of the motor by selectively varying a current or a voltage applied to the motor to control a speed and/or a torque of the motor to drive the lance pump 306 to dispense lubricant via its output to the system. A pressure sensor 314 senses a pressure condition at the output of the lance pump 306 and provides a pressure condition signal 316 indicative of the pressure condition. The controller 312 is responsive to the pressure condition signal 316 and selectively varies the current or the voltage applied to the motor to vary the speed and/or the torque of the motor as a function of a difference between the pressure condition signal 316 and a target pressure condition stored in a tangible, non-transitory memory 318. The memory also stores software control instructions executed by the controller which may include a processor in one embodiment.

In an embodiment in which the motor comprises a stepper motor, the controller 312 selectively applies PWM (pulse width modulated) pulses via a power supply 320 to the stepper motor to vary speed and torque of the stepper motor as a function of the target pressure condition compared to the sensed pressure condition.

In one embodiment, the controller 312 applies PWM pulses to the stepper motor such that the speed of the stepper motor is a first speed and a first torque when the pressure signal is within a first range. In addition, the controller 312 applies PWM pulses to the stepper motor such that the speed of the stepper motor is a second speed less than the first speed and at a second torque greater than the first torque when the pressure signal is within a second range higher than the first range.

In one embodiment, the motor comprises a servo motor and wherein said controller 312 selectively applies a varying voltage to the servo motor to vary speed of the servo motor as a function of the target pressure condition compared to the sensed pressure condition.

For example, the controller 312 applies a voltage and/or current to the servo motor such that the speed of the servo motor is a first speed and at a first torque when the pressure signal is within a first range, and the controller 312 applies a voltage and/or current to the servo motor such that the speed of the servo motor is a second speed less than the first speed and at a second torque greater than the first torque when the pressure signal is within a second range higher than the first range.

Figure 14:
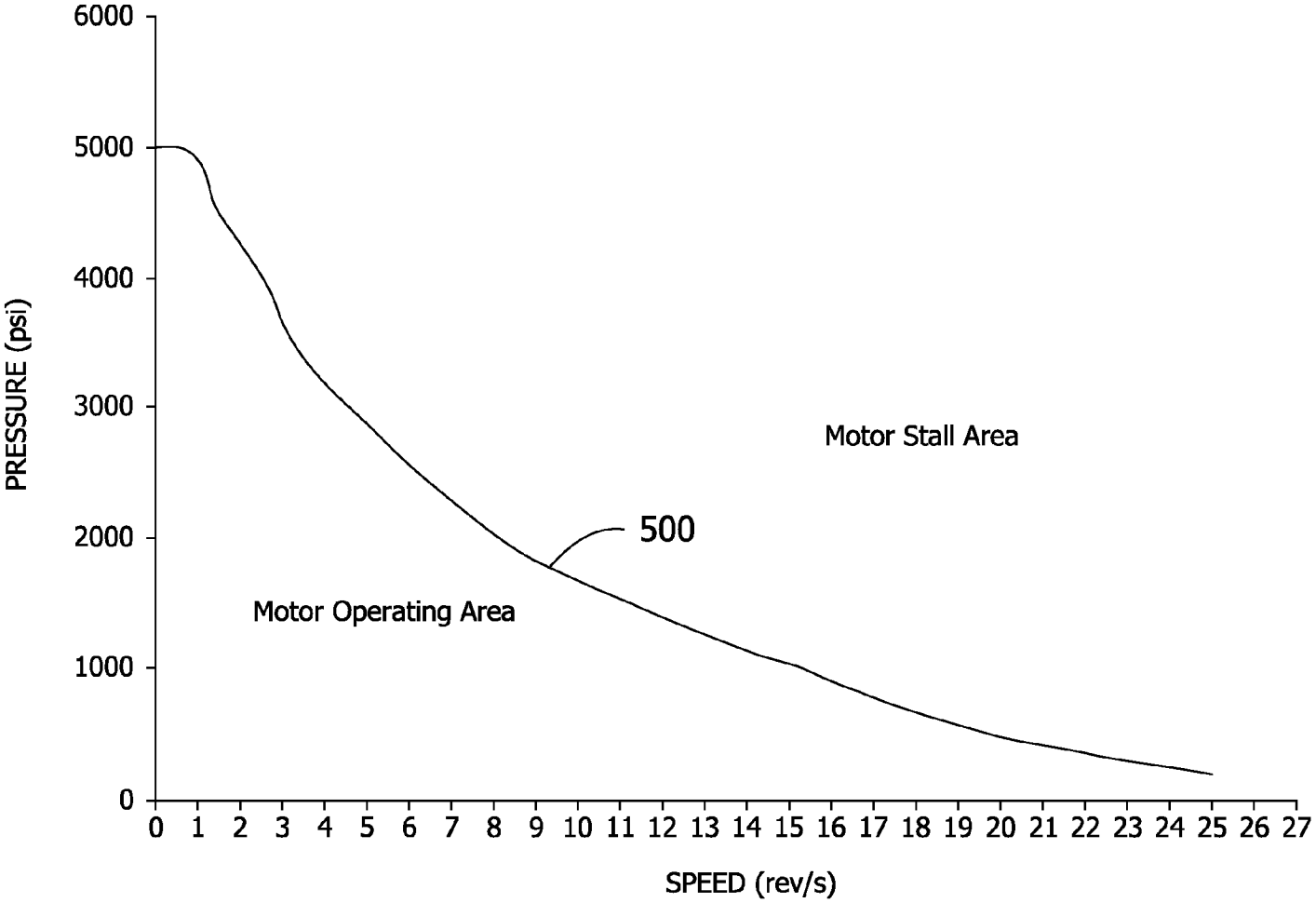
FIG. 14 is a graph illustrating pressure in psi vs. speed in rpm of a stall curve of the motor.

It is also contemplated as an alternative that a profile as illustrated in FIG. 14 or an algorithm for controlling the speed or torque of the motor may be stored in the memory 318 and that the controller 312 controls the speed or torque of the motor as a function of the profile or algorithm. In one embodiment, the target pressure stored in memory 318 is 4000 PSI and the control instructions in the memory 318 are executed by the controller to maximize the lubricant flow and pressure at or below 4000 PSI without stalling the motor. For example, the motor speed (voltage) would be operated as fast as possible and/or the motor current with as much torque as possible without stalling the motor and without saturating the motor stator (e.g., the motor is operated below its stall curve 500 illustrated in FIG. 14). As the pressure increases, the speed of the motor would be decreased and the torque of the motor would be increased. In addition, the motor is operated such that the motor temperature is maintained within its operating range.

When the drive mechanism 310 includes a stepper motor, one embodiment includes control instructions in memory 318 executed by controller 312 resulting in the frequency of PWM pulses applied to the stepper motor decreasing and the pulse width increasing to decrease speed and increase torque as the pressure of the lubricant increases, as indicated by pressure signal 316. The frequency of the pulses applied to the stepper motor would be maintained above a minimum and the width of the pulses would be maintained below a maximum to prevent stalling and to minimize motor temperature. When the drive mechanism 310 includes a servo motor, one embodiment includes control instructions in memory 318 executed by controller 312 resulting in decreasing the voltage applied to the servo motor and increasing the current applied to the servo motor as the pressure increases. The servo motor may have an encoder which provides feedback to the controller 312 indicative of the speed of the servo motor. The voltage applied to the servo motor would be maintained above a minimum and the current applied would be maintained below a maximum to prevent stalling and to minimize motor temperature and to minimize motor saturation.

FIG. 13 illustrates one embodiment of a method for supplying lubricant to a system and illustrates one embodiment of software instruction stored in memory 318. The method includes providing a reservoir 302 for holding lubricant. A lance pump 306 having an input 305 in communication with a reservoir outlet 304 and having an output 308 in communication with the system is also provided. A drive mechanism 310 including a motor comprising at least one of a stepper motor and a servo motor drives the lance pump 306. The operation of the motor is controlled by selectively varying the current or voltage applied to the motor to control a speed and/or a torque of the motor to drive the lance pump 306 to dispense lubricant via its output 308 to the system. A pressure condition at the output 308 of the lance pump 306 is sensed at 402 and compared at 404 a pressure condition signal 316 indicative of the pressure condition. The current or voltage applied to the motor is selectively varied to vary the speed and/or the torque of the motor as a function of a difference between the pressure condition signal 316 and a target pressure condition stored in memory 318.

When the motor comprises a stepper motor, PWM pulses are selectively applied to the stepper motor to vary speed and torque of the stepper motor as a function of the target pressure condition compared to the sensed pressure condition.

In one embodiment, when a difference between the sensed pressure at 402 compared to the target pressure at 404 is within a first range at 406, the PWM pulses are applied to the stepper motor at 408 such that the stepper motor is at a first speed and at a first torque. When the difference at 410 is within a second range higher than the first range, PWM pulses are applied to the stepper motor at 412 such that the stepper motor is at a second speed less than the first speed and at a second torque greater than the first torque.

When the motor comprises a servo motor, the controller 312 selectively applies a varying voltage to the servo motor to vary speed of the servo motor as a function of the target pressure condition stored in memory 318 compared to the sensed pressure condition 316. In particular, a voltage is applied to the servo motor such that the speed of the servo motor is a first speed and at a first torque when the pressure signal is within a first range, and a voltage to the servo motor such that the speed of the servo motor is a second speed less than the first speed and at a second torque greater than the first torque when the pressure signal is within a second range higher than the first range.

As a result of the motor operation as described above, the pressure of lubricant supplied to a system via output 308 is ramped up and maintained close or slightly below the target pressure stored in memory 318. Simultaneously, the volume of lubricant pumped over time is decreased as the pressure increases to avoid excessive pressure and to minimize the release of lubricant via a safety or relief valve of the system. This inhibits excessive back pressure, minimizes motor stalls and promotes more lubricant to be quickly and effectively supplied to the system. As a result, the system and its components are effectively lubricated and the risk of failure due to improperly lubricated components of the system is minimized.

The pump as described above with the fixed core 31 and reciprocable pump tube 121 is capable of reliable operation at relatively high speed, e.g., 600 cycles (600 strokes of the pump tube) per minute, even with heavy viscous grease at low temperatures. It is operable with a relatively short stroke, e.g., a 0.75 inch stroke as above noted, and acts to deliver a metered volume S×A1 of lubricant on each downstroke as well as on each upstroke of the pump tube.

As will be appreciated by those skilled in the art, the lance pump 21 described above has several advantages over many prior commercially available lance pumps. Because the lance pump 21 is driven by a stepper/servo motor capable of turning its output shaft at variable speeds, the output pressure and flow rate provided by the pump can be varied to conform with demand or specific operating conditions and environments. The lance pump is capable of providing viscous liquids at desired pressures on demand. Further, because the motor can run at lower speeds, complicated reduction gearing such as found in some prior commercial lance pumps can be eliminated. It is envisioned that by eliminating the reduction gearing, the cost and complexity of the lance pump may be reduced compared to lance pumps having reduction gearing.

As will be appreciated by those skilled in the art, the lance pump described above may be used in place of other types of lubricant pumps such as those described in U.S. patent application Ser. No. 13/271,862 filed Oct. 12, 2011, entitled, "Pump having Stepper Motor and Overdrive Control," which is incorporated by reference. In such an application the pump can be to provide substantial lubricant flow (e.g., 150 cc/min) during system start up when pressures are low (e.g., 0 psi) and reduced flow after start up (e.g., 10 cc/min) when lubricant pressures are higher (e.g., 5000 psi).

As will also be appreciated by those skilled in the art, the motor may be a servo motor rather than a stepper motor and the control can be modified accordingly.

Having described the invention in detail, it will be apparent that modifications and variations are possible without departing from the scope of the invention defined in the appended claims.

When introducing elements of the present invention or the preferred embodiments(s) thereof, the articles "a", "an", "the", and "said" are intended to mean that there are one or more of the elements. The terms "comprising", "including", and "having" are intended to be inclusive and mean that there may be additional elements other than the listed elements.

In view of the above, it will be seen that the several objects of the invention are achieved and other advantageous results attained.

As various changes could be made in the above constructions without departing from the scope of the invention, it is intended that all matter contained in the above description and shown in the accompanying drawings shall be interpreted as illustrative and not in a limiting sense.

What is claimed is:

1. A lance pump for pumping a viscous liquid from a reservoir, said pump comprising:

a pump body adapted for positioning above said reservoir;

an elongate core extending downward from an upper end fixedly connected to the body, past an upper portion and a lower portion, to a lower end when the body is positioned above said reservoir;

an elongate tube surrounding the core and extending vertically downward from the body into the liquid when the body is in position above the reservoir, the tube having a longitudinal axis extending between an upper end mounted on the body for vertical reciprocating motion and a lower end opposite the upper end extending past the lower end of the core, the tube having an upper closure and a lower closure slidably receiving the core and providing lateral support as the tube reciprocates;

a motor comprising a stepper motor or a servo motor mounted on the body having a selectively rotatable output shaft extending horizontally above the liquid in the reservoir when the body is in position;

a transmission operatively connecting the motor output shaft and the elongate tube for reciprocating the tube between the raised position and the lowered position as the motor output shaft rotates to drive the tube through alternating upward and downward pumping strokes;

an inlet check valve mounted inside the tube below the lower end of the core and defining with the lower end of the core an expansible and contractible lower end chamber, the inlet check valve being oriented to open during each downward pumping stroke of the tube permitting viscous liquid to enter said lower end chamber;

an annular pump chamber defined in part by the tube and the core above the lower end chamber;

a feed passage in the tube connecting the lower end chamber to the annular pump chamber having a feed passage check valve oriented to open during each upward pumping stroke of the tube with the inlet check valve closed to deliver viscous liquid from the lower end chamber to the annular pump chamber;

a pressure monitor in fluid communication with liquid in the pump downstream from the feed passage check valve for measuring pressure of said liquid;

an outlet passage connected to the annular pump chamber permitting viscous liquid to flow from the annular pump chamber to an outlet on each upward pumping stroke and each downward pumping stroke; and a control operatively connected between the pressure monitor and the motor for controlling operation of the motor in response to a signal from the pressure monitor, and wherein the control controls the motor to effect a selected number of upward pumping strokes and downward pumping strokes to deliver a predetermined quantity of viscous liquid through the outlet, thereby providing a predetermined quantity of viscous liquid at a predetermined pressure.

2. A lance pump as set forth in claim 1, wherein the pressure monitor is mounted for sensing pressure of liquid in the outlet passage.

3. A lance pump as set forth in claim 1, wherein the control adjusts motor output shaft speed in response to the signal from the pressure monitor.

4. A lance pump as set forth in claim 3, wherein the control adjusts output shaft speed to maintain pressure sensed by the pressure monitor to be in a range of about 1000 psi to about 3500 psi.

5. A lance pump as set forth in claim 1, wherein the control adjusts output shaft speed in response to flow rate of liquid in the pump.

6. A lance pump for pumping a viscous liquid from a reservoir, said pump comprising:

a pump body adapted for positioning above said reservoir;

an elongate core extending downward from an upper end fixedly connected to the body, past an upper portion and a lower portion, to a lower end when the body is positioned above said reservoir;

an elongate tube surrounding the core and extending vertically downward from the body into the liquid when the body is in position above the reservoir, the tube having a longitudinal axis extending between an upper end mounted on the body for vertical reciprocating motion and a lower end opposite the upper end extending past the lower end of the core, the tube having an upper closure and a lower closure slidably receiving the core and providing lateral support as the tube reciprocates;

an electric motor comprising a stepper motor or a servo motor mounted on the body having a selectively rotatable output shaft operatively connected to the elongate tube for reciprocating the tube between the raised position and the lowered position as the motor output shaft rotates to drive the tube through alternating upward and downward pumping strokes;

a control operatively connected to the electric motor for controlling operation of the motor control in response to at least one characteristic of liquid in the pump selected from a group of characteristics consisting of pressure and flow rate;

an inlet check valve mounted inside the tube below the lower end of the core and defining with the lower end of the core an expansible and contractible lower end chamber, the inlet check valve being oriented to open during each downward pumping stroke of the tube permitting viscous liquid to enter said lower end chamber;

an annular pump chamber defined in part by the tube and the core above the lower end chamber;

a feed passage in the tube connecting the lower end chamber to the annular pump chamber having a feed passage check valve oriented to open during each upward pumping stroke of the tube with the inlet check valve closed to deliver viscous liquid from the lower end chamber to the annular pump chamber; and an outlet passage connected to the annular pump chamber permitting viscous liquid to flow from the annular pump chamber to an outlet on each upward pumping stroke and each downward pumping stroke;

wherein the control controls the motor to effect a selected number of upward pumping strokes and downward pumping strokes to deliver a predetermined quantity of viscous liquid through the outlet, thereby providing a predetermined quantity of viscous liquid having said characteristic.

7. A lance pump as set forth in claim 6, wherein the electric motor comprises a stepper motor.

8. A lance pump as set forth in claim 6, wherein the control adjusts output shaft speed in response to liquid pressure in the pump.

9. A lance pump as set forth in claim 8, further comprising a pressure monitor in fluid communication with liquid in the pump downstream from the feed passage check valve for measuring pressure of the liquid and providing a signal to the control corresponding to the measured pressure.

10. A lance pump as set forth in claim 9, wherein the pressure monitor is mounted for sensing pressure of liquid in the outlet passage.

11. A lance pump as set forth in claim 10, wherein the control adjusts output shaft speed to maintain pressure sensed by the pressure monitor to be in a range of about 1000 psi to about 3500 psi.

* * * * *